US012740590B2

(12) United States Patent
Zhao et al.

(10) Patent No.: US 12,740,590 B2
(45) Date of Patent: Sep. 22, 2026

(54) HEATING ASSEMBLY, VAPORIZER, AND ELECTRONIC VAPORIZATION DEVICE

(71) Applicant: SHENZHEN SMOORE TECHNOLOGY LIMITED, Shenzhen (CN)

(72) Inventors: Yueyang Zhao, Shenzhen (CN); Ming Lv, Shenzhen (CN); Guanghui Li, Shenzhen (CN); Biao Zhang, Shenzhen (CN)

(73) Assignee: SHENZHEN SMOORE TECHNOLOGY LIMITED, Shezhen (CN)

( * ) Notice: Subject to any disclaimer, the term of this patent is extended or adjusted under 35 U.S.C. 154(b) by 577 days.

(21) Appl. No.: 18/092,044

(22) Filed: Dec. 30, 2022

(65) Prior Publication Data

US 2023/0210183 A1 Jul. 6, 2023

Related U.S. Application Data

(63) Continuation of application No. PCT/CN2021/143267, filed on Dec. 30, 2021.

(51) Int. Cl.
*A24F 40/46* (2020.01)
*A24F 40/10* (2020.01)
*A24F 40/44* (2020.01)

(52) U.S. Cl.
CPC ..... *A24F 40/46* (2020.01); *A24F 40/10* (2020.01); *A24F 40/44* (2020.01)

(58) Field of Classification Search
CPC ..... A24F 40/10; A24F 40/44; A24F 40/46
See application file for complete search history.

(56) References Cited

U.S. PATENT DOCUMENTS

2017/0105455 A1 4/2017 Qiu
2017/0224018 A1 8/2017 Li et al.
(Continued)

FOREIGN PATENT DOCUMENTS

CN 104279905 A 1/2015
CN 105192894 A 12/2015
(Continued)

OTHER PUBLICATIONS

Ponce de Leon et al, "Optimization of capillary flow through open microchannel and open micropillar arrays." (Year: 2016).*
(Continued)

*Primary Examiner* — Christopher M Rodd
*Assistant Examiner* — Ronnie Kirby Jordan
(74) *Attorney, Agent, or Firm* — Leydig, Voit & Mayer, Ltd.

(57) ABSTRACT

A heating assembly for a vaporizer is disclosed. The heating assembly includes a first substrate and a second substrate. The first substrate includes a first surface and a second surface arranged opposite to each other. The first surface is a liquid absorbing surface. The first substrate includes a plurality of first micropores configured to guide an aerosol-generation substrate from the liquid absorbing surface to the second surface. The second substrate includes a third surface and a fourth surface arranged opposite to each other. The fourth surface is a vaporization surface. The second surface and the third surface are arranged opposite to each other.

36 Claims, 10 Drawing Sheets

(56) References Cited

U.S. PATENT DOCUMENTS

| | | | | |
|---|---|---|---|---|
| 2018/0154090 | A1 | 6/2018 | Anderson et al. | |
| 2019/0297946 | A1 | 10/2019 | Fu et al. | |
| 2020/0060344 | A1* | 2/2020 | Tan et al. | A24F 40/46 |
| 2020/0214361 | A1 | 7/2020 | Zhao et al. | |
| 2020/0320423 | A1* | 10/2020 | Shi et al. | |
| 2020/0397052 | A1 | 12/2020 | Pelz et al. | |
| 2021/0112871 | A1 | 4/2021 | Kalaydzhyan | |

FOREIGN PATENT DOCUMENTS

| | | | |
|---|---|---|---|
| CN | 105559150 | A | 5/2016 |
| CN | 105919164 | A | 9/2016 |
| CN | 104053372 | B | 5/2017 |
| CN | 108158039 | A | 6/2018 |
| CN | 108158040 | A | 6/2018 |
| CN | 108185536 | A | 6/2018 |
| CN | 207855026 | U | 9/2018 |
| CN | 208371553 | U | 1/2019 |
| CN | 109363248 | A | 2/2019 |
| CN | 109770438 | A | 5/2019 |
| CN | 109770439 | A | 5/2019 |
| CN | 209498589 | U | 10/2019 |
| CN | 110447959 | A | 11/2019 |
| CN | 110558632 | A | 12/2019 |
| CN | 110623308 | A | 12/2019 |
| CN | 110934343 | A | 3/2020 |
| CN | 111109665 | A | 5/2020 |
| CN | 111436664 | A | 7/2020 |
| CN | 111567894 | A | 8/2020 |
| CN | 111631437 | A | 9/2020 |
| CN | 211746945 | U | 10/2020 |
| CN | 211746949 | U | 10/2020 |
| CN | 111989004 | A | 11/2020 |
| CN | 112021671 | A | 12/2020 |
| CN | 112089105 | A | 12/2020 |
| CN | 112120291 | A | 12/2020 |
| CN | 112293801 | A | 2/2021 |
| CN | 112385898 | A | 2/2021 |
| CN | 212464919 | U | 2/2021 |
| CN | 112841745 | A | 5/2021 |
| CN | 113115987 | A | 7/2021 |
| CN | 113331484 | A | 9/2021 |
| CN | 214127012 | U | 9/2021 |
| CN | 113508924 | A | 10/2021 |
| CN | 214431782 | U | 10/2021 |
| CN | 214431825 | U | 10/2021 |
| CN | 113576038 | A | 11/2021 |
| CN | 113598436 | A | 11/2021 |
| CN | 113647696 | A | 11/2021 |
| CN | 113662250 | A | 11/2021 |
| CN | 113727618 | A | 11/2021 |
| CN | 214629849 | U | 11/2021 |
| CN | 214710349 | U | 11/2021 |
| CN | 214898758 | U | 11/2021 |
| CN | 214903781 | U | 11/2021 |
| CN | 215075503 | U | 12/2021 |
| CN | 215224778 | U | 12/2021 |
| CN | 215303052 | U | 12/2021 |
| CN | 216019130 | U | 3/2022 |
| CN | 114365870 | A | 4/2022 |
| CN | 114794577 | A | 7/2022 |
| CN | 114794578 | A | 7/2022 |
| CN | 114794579 | A | 7/2022 |
| CN | 114916708 | A | 8/2022 |
| CN | 218164288 | U | 12/2022 |
| CN | 218682034 | U | 3/2023 |
| CN | 218921698 | U | 4/2023 |
| CN | 117652718 | A | 3/2024 |
| CN | 220756580 | U | 4/2024 |
| CN | 220800051 | U | 4/2024 |
| CN | 220800052 | U | 4/2024 |
| CN | 221265251 | U | 7/2024 |
| EP | 3545779 | A1 | 10/2019 |
| EP | 3620071 | A1 | 3/2020 |
| EP | 3711599 | A1 | 9/2020 |
| JP | 2008104966 | A | 5/2008 |
| WO | 2018161254 | A1 | 9/2018 |
| WO | 2021083130 | A1 | 5/2021 |
| WO | 2021104151 | A1 | 6/2021 |
| WO | 2021143328 | A1 | 7/2021 |
| WO | 2021163950 | A1 | 8/2021 |
| WO | 2021169654 | A1 | 9/2021 |
| WO | 2021194048 | A1 | 9/2021 |
| WO | 2021198649 | A1 | 10/2021 |
| WO | 2021240384 | A1 | 12/2021 |
| WO | 2021243843 | A1 | 12/2021 |
| WO | 2022170425 | A1 | 8/2022 |
| WO | 2022179300 | A2 | 9/2022 |
| WO | 2022179642 | A2 | 9/2022 |
| WO | 2023000799 | A1 | 1/2023 |

OTHER PUBLICATIONS

CN113662250A_Espacenet_Machine English Translation (Year: 2025).*

Chinese Patent Office, First Office Action in Chinese Patent Application No. 202111656304.X (Mar. 13, 2025).

Chinese Patent Office, Notification of grant of patent right for invention in Chinese Patent Application No. 202111652068.4 (Mar. 25, 2025).

Chinese Patent Office, First Office Action in Chinese Patent Application No. 202111656422.0 (Jan. 15, 2025).

Chinese Patent Office, First Office Action in Chinese Patent Application No. 202290000072.4 (Nov. 23, 2022).

Chinese Patent Office, Notification of grant of patent right for invention in Chinese Patent Application No. 202111656304.X (Apr. 14, 2025).

Patent Cooperation Treaty, International Search Report and Written Opinion, International Application No. PCT/CN2022/092863 (Sep. 2, 2022).

European Patent Office, Search Report in European Patent Application No. 22759008.0 (Dec. 12, 2023).

Chinese Patent Office, Notification of grant of patent right for invention in Chinese Patent Application No. 202111681913.0 (Mar. 25, 2025).

Chinese Patent Office, Notification of grant of patent right for invention in Chinese Patent Application No. 202210524026.0 (Mar. 20, 2025).

Chinese Patent Office, First Office Action in Chinese Patent Application No. 202210524026.0 (Dec. 19, 2024).

Chinese Patent Office, First Office Action in Chinese Patent Application No. 202210524878.X (Jan. 16, 2025).

Patent Cooperation Treaty, International Search Report and Written Opinion, International Application No. PCT/CN2022/092861 (Jan. 12, 2023).

Chinese Patent Office, Second Office Action in Chinese Patent Application No. 202111681913.0 (Jan. 22, 2025).

European Patent Office, Search Report in European Patent Application No. 22913673.4 (Mar. 14, 2025).

European Patent Office, Search Report in European Patent Application No. 21946245.4 (Aug. 21, 2023).

European Patent Office, Search Report in European Patent Application No. 21927724.1 (Nov. 16, 2023).

European Patent Office, Intention to grant in European Patent Application No. 21946245.4 (May 9, 2025).

Chinese Patent Office, Notification of grant of patent right for invention in Chinese Patent Application No. 202111656422.0 (Apr. 28, 2025).

Chinese Patent Office, Notification of grant of patent right for invention in Chinese Patent Application No. 202210524878.X (May 29, 2025).

Chinese Patent Office, Office Action in Chinese Patent Application No. 202211387650.7 (Jun. 14, 2025).

Patent Cooperation Treaty, International Search Report and Written Opinion, International Application No. PCT/CN2021/143260 (Sep. 7, 2022).

(56) References Cited

OTHER PUBLICATIONS

Patent Cooperation Treaty, International Search Report and Written Opinion, International Application No. PCT/CN2021/143267 (Sep. 8, 2022).
Patent Cooperation Treaty, International Search Report, International Application No. PCT/CN2021/143259 (Sep. 16, 2022).
Patent Cooperation Treaty, Written Opinion of the International Searching Authority, International Application No. PCT/CN2021/143259 (Sep. 16, 2022).
Patent Cooperation Treaty, International Search Report and Written Opinion, International Application No. PCT/CN2021/143268 (Sep. 7, 2022).
Patent Cooperation Treaty, International Search Report and Written Opinion, International Application No. PCT/CN2022/125701 (Dec. 27, 2022).
Patent Cooperation Treaty, International Search Report and Written Opinion, International Application No. PCT/CN2022/115306 (Nov. 15, 2022).
Patent Cooperation Treaty, International Search Report and Written Opinion, International Application No. PCT/CN2022/143581 (Mar. 14, 2023).
Chinese Patent Office, Office Action in Chinese Patent Application No. 202111652068.4 (Dec. 20, 2024).
Patent Cooperation Treaty, International Search Report and Written Opinion, International Application No. PCT/CN2022/129354 (Jan. 20, 2023).
Chinese Patent Office, Office Action in Chinese Patent Application No. 202111681913.0 (Aug. 16, 2024).
U.S. Patent and Trademark Office, Notice of Allowance in U.S. Appl. No. 18/091,991 (Jul. 18, 2025).
U.S. Patent and Trademark Office, Corrected Notice of Allowance in U.S. Appl. No. 18/091,991 (Jul. 30, 2025).
Chinese Patent Office, Office Action in Chinese Patent Application No. 202211045817.1 (Dec. 22, 2025).
Chinese Patent Office, Office Action in Chinese Patent Application No. 202111656286.5 (Dec. 24, 2025).
U.S. Patent and Trademark Office, Restriction Requirement in U.S. Appl. No. 18/092,017 (Mar. 11, 2026).
Chinese Patent Office, Office Action in Chinese Patent Application No. 202211269081.6 (Mar. 9, 2026).
Chinese Patent Office, Office Action in Chinese Patent Application No. 202211045817.1 (Jun. 5, 2026).
Chinese Patent Office, Office Action in Chinese Patent Application No. 202111656286.5 (Jun. 11, 2026).
U.S. Patent and Trademark Office, Office Action in U.S. Appl. No. 18/092,017 (Jun. 30, 2026).

* cited by examiner

HEATING ASSEMBLY, VAPORIZER, AND ELECTRONIC VAPORIZATION DEVICE

CROSS-REFERENCE TO RELATED APPLICATION

This application is a continuation of International Application No. PCT/CN2021/143267, filed on Dec. 30, 2021, the entire disclosure of which is hereby incorporated by reference.

TECHNICAL FIELD

This application relates to the field of electronic vaporization technologies, and in particular, to a heating assembly, a vaporizer, and an electronic vaporization device.

BACKGROUND

An electronic vaporization device is formed by components such as a heating body, a battery, and a control circuit. The heating body is a core component of the electronic vaporization device, and characteristics thereof decide a vaporization effect and use experience of the electronic vaporization device.

One type of the existing heating body is a cotton core heating body. Most cotton core heating bodies are in a structure of a spring-shaped metal heating wire wrapped on a cotton rope or a fiber rope. A to-be-vaporized liquid aerosol-generation substrate is absorbed by two ends of the cotton rope or fiber rope and then transmitted to the centered metal heating wire for heating and vaporization. Because an area of an end portion of the cotton rope or the fiber rope is limited, the absorption efficiency and the transmission efficiency of the aerosol-generation substrate are relatively low. In addition, the structure stability of the cotton rope or the fiber rope is poor. As a result, phenomena such as dry burning, carbon accumulation, and a burnt flavor are likely to occur after a plurality of times of thermal cycling.

Another type of the existing heating body is a ceramic heating body. In most ceramic heating bodies, a metal heating film is formed on a surface of a porous ceramic body. The porous ceramic body plays a role of liquid guiding and liquid storage, and the metal heating film heats and vaporizes the liquid aerosol-generation substrate. However, it is hard for a porous ceramic manufactured through high-temperature sintering to accurately control position distribution and size precision of micropores. To reduce a risk of liquid leakage, a pore size and a porosity need to be decreased, but to implement sufficient liquid supplying, the pore size and the porosity need to be increased, which conflict with each other. At present, with the pore size and the porosity meeting a condition of a low liquid leakage risk, a liquid guiding capability of a porous ceramic substrate is limited, and a burnt flavor is generated under a high power condition.

As technologies advance, requirements of a user on the vaporization effect of the electronic vaporization device become increasingly high. To meet the requirements of the user, a thin heating body is provided to improve a liquid supplying capability. However, bubbles are easily formed on a liquid absorbing surface of the thin heating body, which blocks liquid intaking and leads to dry burning of the heating body.

SUMMARY

This application provides a heating assembly, a vaporizer, and an electronic vaporization device, to resolve the technical problem that bubbles are easily formed on a liquid absorbing surface in a thin heating body in the related art.

To resolve the foregoing technical solution, a first technical solution provided in this application is to provide a heating assembly, including a first substrate and a second substrate, where the first substrate includes a first surface and a second surface arranged opposite to each other, where the first surface is a liquid absorbing surface; the first substrate includes a plurality of first micropores, and the plurality of first micropores are configured to guide an aerosol-generation substrate from the liquid absorbing surface to the second surface; the second substrate includes a third surface and a fourth surface arranged opposite to each other, where the fourth surface is a vaporization surface; the second surface and the third surface are arranged opposite to each other; the second substrate is a dense substrate, a plurality of second micropores running through the third surface and the fourth surface are provided on the second substrate, and the plurality of second micropores are configured to guide the aerosol-generation substrate from the third surface to the vaporization surface; and the first substrate and/or the second substrate form a flow channel, and the flow channel communicates the plurality of first micropores and the plurality of second micropores.

The second surface and the third surface are spaced to form a gap, and the gap serves as the flow channel.

The heating assembly further includes a spacer; and the spacer is arranged between the second surface and the third surface and is arranged at an edge of the first substrate and/or an edge of the second substrate, so that the first substrate and the second substrate are spaced to form the gap.

The spacer is an independently arranged gasket; or the spacer is a support column or a support frame fixed to the second surface and/or the third surface; or the spacer is a protrusion integrally formed with the first substrate and/or the second substrate.

The heating assembly further includes a seal member, and the seal member includes a liquid supplying hole; and a fixing structure is arranged on a hole wall of the liquid supplying hole, to fix the first substrate and/or the second substrate, so that the first substrate and the second substrate are spaced to form the gap.

A height of the gap is the same in a direction parallel to the first substrate.

A height of the gap is gradually increased in a direction parallel to the first substrate.

The height of the gap is gradually increased from zero.

The heating assembly further includes a plurality of microcolumns, and the plurality of microcolumns are arranged in the gap.

One end of each of the plurality of microcolumns abuts against the second surface, and an other end of each of the plurality of microcolumns and the third surface are spaced; or one end of each of the plurality of microcolumns abuts against the third surface, and an other end of each of the plurality of microcolumns and the second surface are spaced; or one end of each of the plurality of microcolumns abuts against the second surface, and an other end of each of the plurality of microcolumns abuts against the third surface.

A plurality of first grooves extending in a first direction and a plurality of second grooves extending in a second direction are provided on the third surface, and the plurality of first grooves and the plurality of second grooves are provided in an intersecting manner; and the plurality of first grooves and the plurality of second grooves form the flow channel.

The plurality of second micropores are distributed in an array, each of the plurality of first grooves corresponds to one row or a plurality of rows of second micropores, and each of the plurality of second grooves corresponds to one column or a plurality of columns of second micropores.

A ratio of a depth to a width of each of the plurality of first grooves ranges from 0 to 20, and a ratio of a depth to a width of each of the plurality of second grooves ranges from 0 to 20.

A plurality of third grooves extending in a third direction and a plurality of fourth grooves extending in a fourth direction are provided on the second surface, and the plurality of third grooves and the plurality of fourth grooves are provided in an intersecting manner; and the plurality of first grooves, the plurality of second grooves, the plurality of third grooves, and the plurality of fourth grooves together form the flow channel.

The first substrate is a dense substrate, and the plurality of first micropores run through the first surface and the second surface; and the plurality of first micropores are distributed in an array, each of the plurality of third grooves corresponds to one row or a plurality of rows of first micropores, and each of the plurality of fourth grooves corresponds to one column or a plurality of columns of first micropores.

A ratio of a depth to a width of each of the plurality of third grooves ranges from 0 to 20, and a ratio of a depth to a width of each of the plurality of fourth grooves ranges from 0 to 20.

Capillary force of the plurality of first grooves and the plurality of second grooves is greater than capillary force of the plurality of third grooves and the plurality of fourth grooves.

The second surface and the third surface are spaced to form a gap.

The second surface is in contact with the third surface.

The depth of each of the plurality of first grooves and the depth of each of the plurality of second grooves are greater than the depth of each of the plurality of third grooves and the depth of each of the plurality of fourth grooves.

A central axis of each of the plurality of second micropores is perpendicular to the third surface.

A thickness of the second substrate ranges from 0.1 mm to 1 mm, and a pore size of each of the plurality of second micropores ranges from 1 μm to 100 μm.

A ratio of a thickness of the second substrate to a pore size of each of the plurality of second micropores ranges from 20:1 to 3:1.

A ratio of a distance between centers of adjacent second micropores to a pore size of each of the plurality of second micropores ranges from 3:1 to 5:1.

The first substrate is a dense substrate, and the plurality of first micropores run through the first surface and the second surface.

Capillary force of the plurality of second micropores is greater than capillary force of the plurality of first micropores.

In a thickness direction of the first substrate, a pore size of each of the plurality of first micropores is gradually increased; and a shrinking opening of each of the plurality of first micropores is provided on the first surface, and an expanding opening of each of the plurality of first micropores is provided on the second surface.

A projection of a region on the first substrate where the plurality of first micropores are provided on the second substrate totally covers a region on the second substrate where the plurality of second micropores are provided.

A pore size of each of the plurality of first micropores ranges from 1 μm to 100 μm.

A thickness of the first substrate is less than a thickness of the second substrate.

The heating assembly further includes a heating component, and the heating component is an independent component arranged on the vaporization surface; or the second substrate includes a conductive function.

A projection of the first substrate on the vaporization surface totally covers the heating component.

To resolve the foregoing technical solution, a second technical solution provided in this application is to provide a heating assembly, including a first substrate and a second substrate, where the first substrate includes a first surface and a second surface arranged opposite to each other, where the first surface is a liquid absorbing surface; the first substrate includes a plurality of first micropores and the plurality of first micropores are configured to guide an aerosol-generation substrate from the liquid absorbing surface to the second surface; the second substrate includes a third surface and a fourth surface arranged opposite to each other, where the fourth surface is a vaporization surface; the second surface and the third surface are arranged opposite to each other; the second substrate includes a plurality of second micropores, and the plurality of second micropores are configured to guide the aerosol-generation substrate from the third surface to the vaporization surface; and the first substrate and/or the second substrate form a flow channel, and the flow channel communicates the plurality of first micropores and the plurality of second micropores.

To resolve the foregoing technical solution, a third technical solution provided in this application is to provide a vaporizer, including a liquid storage cavity and a heating assembly, where the liquid storage cavity is configured to store an aerosol-generation substrate; and the heating assembly is in fluid communication with the liquid storage cavity and configured to vaporize the aerosol-generation substrate, where the heating assembly is the heating assembly according to any one of the foregoing.

To resolve the foregoing technical solution, a fourth technical solution provided in this application is to provide an electronic vaporization device, including a vaporizer and a main unit, where the vaporizer is the vaporizer according to the foregoing; and the main unit is configured to supply electric energy for operation of the vaporizer and control the heating assembly to vaporize the aerosol-generation substrate.

This application provides a heating assembly, a vaporizer, and an electronic vaporization device. The heating assembly includes a first substrate and a second substrate; the first substrate includes a first surface and a second surface arranged opposite to each other, where the first surface is a liquid absorbing surface; the first substrate includes a plurality of first micropores and the plurality of first micropores are configured to guide an aerosol-generation substrate from the liquid absorbing surface to the second surface; the second substrate includes a third surface and a fourth surface arranged opposite to each other, where the fourth surface is a vaporization surface; the second surface and the third surface are arranged opposite to each other; the second substrate is a dense substrate, a plurality of second micropores running through the third surface and the fourth surface are provided on the second substrate, and the plurality of second micropores are configured to guide the aerosol-generation substrate from the third surface to the vaporization surface; and the first substrate and/or the second substrate form a flow channel, and the flow channel communicates the plurality of first micropores and the plurality of second micropores. Therefore, bubbles may be removed through the flow channel, thereby preventing bubbles form being formed on the liquid absorbing surface to block liquid supplying and further preventing dry burning.

BRIEF DESCRIPTION OF THE DRAWINGS

To describe the technical solutions in embodiments of this application more clearly, the following briefly introduces the accompanying drawings required for describing the embodiments. Apparently, the accompanying drawings in the following description show merely some embodiments of this application, and a person of ordinary skill in the art may still derive other accompanying drawings from these accompanying drawings without creative efforts.

DETAILED DESCRIPTION

The technical solutions in embodiments of this application are clearly and completely described below with reference to the accompanying drawings in the embodiments of this application. Apparently, the described embodiments are merely some rather than all of the embodiments of this application. All other embodiments obtained by a person of ordinary skill in the art based on the embodiments of this application without creative efforts shall fall within the protection scope of this application.

In the following description, for the purpose of illustration rather than limitation, specific details such as the specific system structure, interface, and technology are proposed to thoroughly understand this application.

The terms "first", "second", and "third" in this application are merely intended for a purpose of description, and shall not be understood as indicating or implying relative significance or implicitly indicating the number of indicated technical features. Therefore, features defining "first", "second", and "third" can explicitly or implicitly include at least one of the features. In the description of this application, "a plurality of" means at least two, such as two and three unless it is specifically defined otherwise. All directional indications (for example, upper, lower, left, right, front, and rear) in the embodiments of this application are only used for explaining relative position relationships, movement situations, or the like between various components in a specific posture (as shown in the accompanying drawings). If the specific posture changes, the directional indications change accordingly. In the embodiments of this application, the terms "include", "have", and any variant thereof are intended to cover a non-exclusive inclusion. For example, a process, method, system, product, or device that includes a series of steps or units is not limited to the listed steps or units, but further optionally includes a step or unit that is not listed, or further optionally includes another step or component that is intrinsic to the process, method, product, or device.

"Embodiment" mentioned in this specification means that particular features, structures, or characteristics described with reference to the embodiment may be included in at least one embodiment of this application. The term appearing at different positions of this specification may not refer to the same embodiment or an independent or alternative embodiment that is mutually exclusive with another embodiment. A person skilled in the art explicitly or implicitly understands that the embodiments described in this specification may be combined with other embodiments.

This application is described in detail below with reference to the accompanying drawings and the embodiments.

Figure 1:
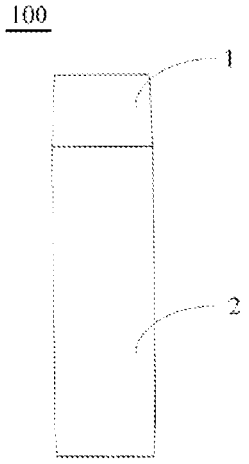
FIG. 1 is a schematic structural diagram of an embodiment of an electronic vaporization device according to this application.

Referring to FIG. 1, FIG. 1 is a schematic structural diagram of an embodiment of an electronic vaporization device according to this application. In this embodiment, an electronic vaporization device 100 is provided. The electronic vaporization device 100 may be configured to vaporize an aerosol-generation substrate. The electronic vaporization device 100 includes a vaporizer 1 and a main unit 2 that are electrically connected to each other.

The vaporizer 1 is configured to store an aerosol-generation substrate and vaporize the aerosol-generation substrate to form aerosols that can be inhaled by a user. The vaporizer 1 specifically may be applied to different fields such as medical care, cosmetology, and recreation inhalation. In a specific embodiment, the vaporizer 1 may be applied to an electronic aerosol vaporization device to vaporize an aerosol-generation substrate and generate aerosols for inhalation by an inhaler, and the following embodiments are described by using the recreation inhalation as an example. Certainly, in some other embodiments, the vaporizer 1 may also be applied to a hair spray device to vaporize hair spray used for hair styling; or applied to a device treating upper and lower respiratory system diseases to vaporize medicine.

For a specific structure and functions of the vaporizer 1, reference may be made to the specific structure and functions of the vaporizer 1 involved in any one of the following embodiments, same or similar technical effects may also be implemented, and details are not described herein again.

The main unit 2 includes a battery (not shown in the figure) and a controller (not shown in the figure). The battery is configured to supply electric energy for operation of the vaporizer 1, to cause the vaporizer 1 to vaporize the aerosol-generation substrate to form aerosols. The controller is configured to control operation of the vaporizer 1. The main unit 2 further includes other components such as a battery holder and an airflow sensor.

The vaporizer 1 and the main unit 2 may be integrally arranged or may be detachably connected to each other, which may be designed according to a specific requirement.

Figure 2:
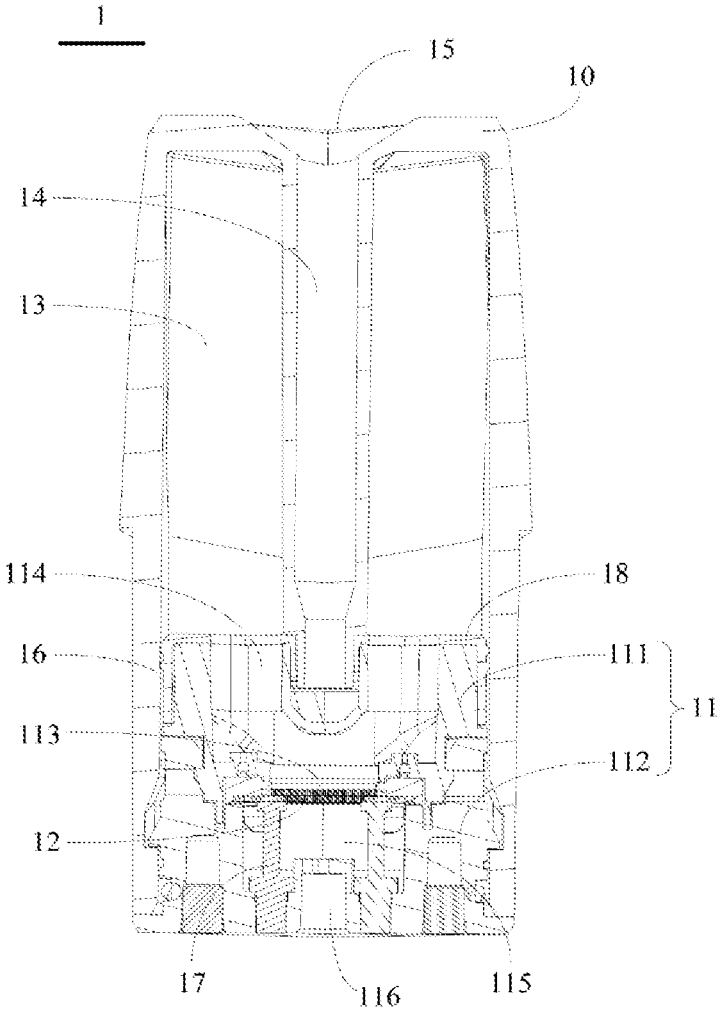
FIG. 2 is a schematic structural diagram of a vaporizer according to an embodiment of this application.

Referring to FIG. 2, FIG. 2 is a schematic structural diagram of a vaporizer according to an embodiment of this application.

The vaporizer 1 includes a housing 10, a vaporization base 11, and a heating assembly 12. The housing 10 includes a liquid storage cavity 13 and an air outlet channel 14, where the liquid storage cavity 13 is configured to store a liquid aerosol-generation substrate, and the liquid storage cavity 13 is provided surrounding the air outlet channel 14. An inhalation opening 15 is further provided on an end portion of the housing 10, and the inhalation opening 15 is in communication with the air outlet channel 14. Specifically, an end opening of the air outlet channel 14 may form the inhalation opening 15. A holding cavity 16 is provided on one side of the liquid storage cavity 13 that is away from the inhalation opening 15 of the housing 10, and the vaporization base 11 is arranged in the holding cavity 16. The vaporization base 11 includes a vaporization top base 111 and a vaporization bottom base 112. The vaporization top base 111 cooperates with the vaporization bottom base 112 to form an accommodating cavity 113. That is, the vaporization base 11 includes the accommodating cavity 113. The heating assembly 12 is arranged in the accommodating cavity 113 and is arranged together with the vaporization base 11 in the holding cavity 16.

Two fluid channels 114 are provided on the vaporization top base 111. Specifically, the two fluid channels 114 are provided on a top wall of the vaporization top base 111, and the two fluid channels 114 are provided on two sides of the air outlet channel 14. One end of each of the fluid channels 114 is in communication with the liquid storage cavity 13, and the other end is in communication with the accommodating cavity 113. That is, the fluid channels 114 communicate the liquid storage cavity 13 and the accommodating cavity 113, so that the aerosol-generation substrate in the liquid storage cavity 13 enters the heating assembly 12 through the fluid channels 114. That is, the heating assembly 12 is in fluid communication with the liquid storage cavity 13, and the heating assembly 12 is configured to absorb and heat and vaporize the aerosol-generation substrate. The controller of the main unit 2 controls the heating assembly 12 to vaporize the aerosol-generation substrate.

In this embodiment, a surface of the heating assembly 12 that is away from the liquid storage cavity 13 is a vaporization surface, a vaporization cavity 115 is formed between the vaporization surface of the heating assembly 12 and an inner wall surface of the accommodating cavity 113, and the vaporization cavity 115 is in communication with the air outlet channel 14. An air inlet 116 is provided on the vaporization bottom base 112, so that the vaporization cavity 115 is in communication with the outside. External air enters the vaporization cavity 115 through the air inlet 116, carries aerosols vaporized by the heating assembly 12 to enter the air outlet channel 14, and finally reaches the inhalation opening 15 to be inhaled by the user.

The vaporizer 1 further includes a conductor 17, and the conductor 17 is fixed to the vaporization bottom base 112. One end of the conductor 17 is electrically connected to the heating assembly 12, and the other end is electrically connected to the main unit 2, so that the heating assembly 12 can work.

The vaporizer 1 further includes a sealing top cap 18. The sealing top cap 18 is arranged on a surface of the vaporization top base 111 that is close to the liquid storage cavity 13 and configured to implement sealing between the liquid storage cavity 13 and the vaporization top base 111 and the air outlet channel 14, to prevent liquid leakage. Optionally, a material of the sealing top cap 18 is silicone or fluoro rubber.

Figure 3A:
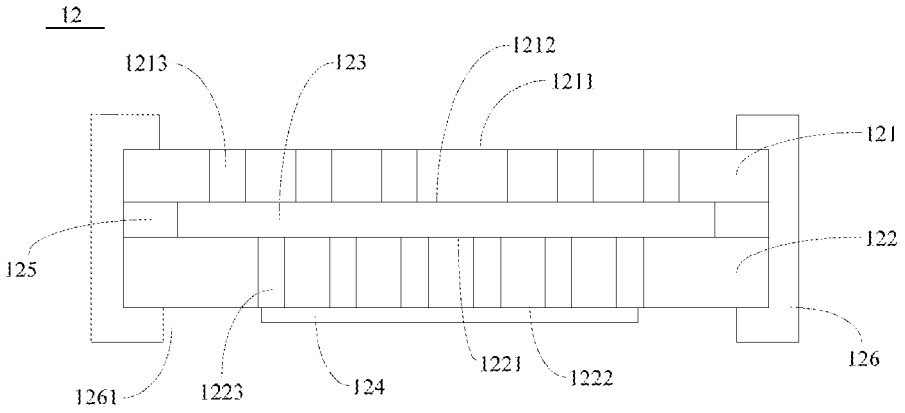
FIG. 3*a* is a schematic structural diagram of a first embodiment of a heating assembly according to this application.
Figure 3B:
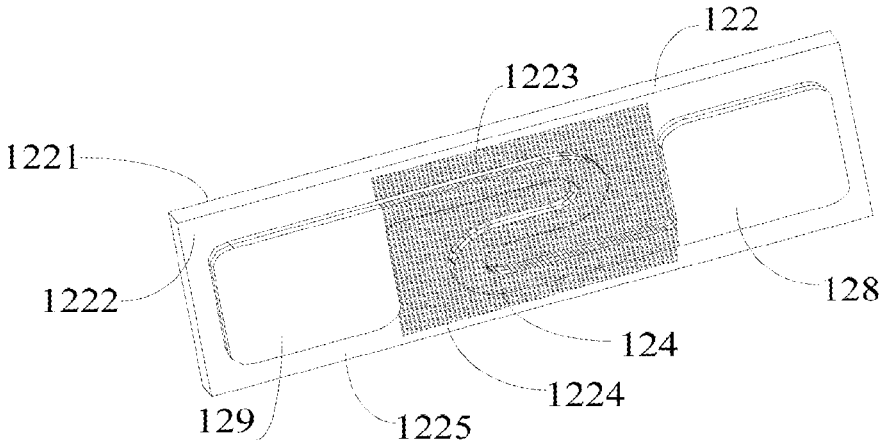
FIG. 3*b* is a schematic structural diagram of a second substrate in the heating assembly provided in FIG. 3*a* viewing from one side of a vaporization surface.
Figure 3C:
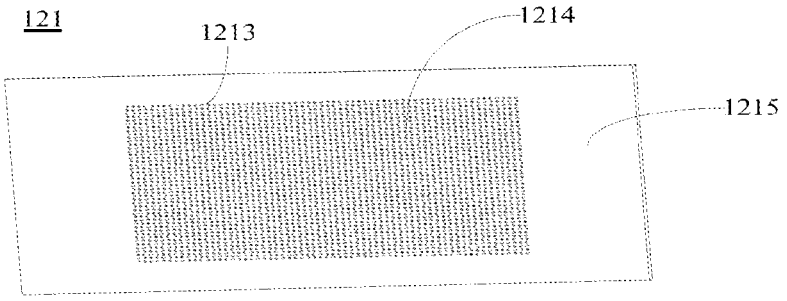
FIG. 3*c* is a schematic structural diagram of a first substrate in the heating assembly provided in FIG. 3*a* viewing from one side of a liquid absorbing surface.

Referring to FIG. 3*a*, FIG. 3*b*, and FIG. 3*c*, FIG. 3*a* is a schematic structural diagram of a first embodiment of a heating assembly according to this application, FIG. 3*b* is a schematic structural diagram of a second substrate in the heating assembly provided in FIG. 3*a* viewing from one side of a vaporization surface, and FIG. 3*c* is a schematic structural diagram of a first substrate in the heating assembly provided in FIG. 3*a* viewing from one side of a liquid absorbing surface.

The heating assembly 12 includes a first substrate 121 and a second substrate 122. The first substrate 121 includes a first surface 1211 and a second surface 1212 arranged opposite to each other, where the first surface 1211 is a liquid absorbing surface; and the first substrate 121 includes a plurality of first micropores 1213, and the plurality of first micropores 1213 are configured to guide an aerosol-generation substrate from the first surface 1211 to the second surface 1212. That is, the plurality of first micropores 1213 are configured to guide the aerosol-generation substrate from the liquid absorbing surface to the second surface 1212. The second substrate 122 includes a third surface 1221 and a fourth surface 1222 arranged opposite to each other, where the fourth surface 1222 is a vaporization surface; and the second substrate 122 includes a plurality of second micropores 1223, and the plurality of second micropores 1223 are configured to guide the aerosol-generation substrate from the third surface 1221 to the fourth surface 1222. That is, the plurality of second micropores 1223 are configured to guide the aerosol-generation substrate from the third surface 1221 to the vaporization surface. The second surface 1212 and the third surface 1221 are arranged opposite to each other. The first substrate 121 and/or the second substrate 122 form a flow channel and the flow channel communicates the plurality of first micropores 1213 and the plurality of second micropores 1223. It may be understood that, under the action of gravity and/or capillary force, the aerosol-generation substrate flows from the liquid absorbing surface to the vaporization surface.

Through the foregoing arrangement, the heating assembly 12 provided in this application includes a relatively high liquid supplying capability, and a large bubble may be prevented from being formed on the liquid absorbing surface to block liquid supplying through the flow channel, thereby further preventing dry burning.

In this embodiment, the second surface 1212 and the third surface 1221 are spaced to form a gap 123, and the gap 123 serves as the flow channel. That is, the second surface 1212 of the first substrate 121 cooperates with the third surface 1221 of the second substrate 122 to form the flow channel. By forming the gap 123 between the first substrate 121 and the second substrate 122, bubbles entering from the vaporization surface during vaporization may be removed, thereby preventing bubbles from being formed on the liquid absorbing surface to block liquid supplying, preventing the bubbles from entering the liquid storage cavity 13 to block liquid supplying, and further preventing dry burning.

The first substrate 121 may be a porous substrate, for example, porous ceramic, cotton, quartz sand core, or a material of a foam structure. The first substrate 121 may also be a dense substrate. When the first substrate 121 is a dense substrate, a material of the first substrate 121 is glass, dense ceramic, or silicon. When the material of the first substrate 121 is glass, the glass may be one of common glass, quartz glass, borosilicate glass, or photosensitive lithium aluminosilicate glass. In a specific implementation, the first substrate 121 is borosilicate glass. In another specific implementation, the first substrate 121 is photosensitive lithium aluminosilicate glass.

The second substrate 122 may be a porous substrate, for example, porous ceramic, cotton, quartz sand core, or a material of a foam structure. The second substrate 122 may also be a dense substrate. When the second substrate 122 is a dense substrate, a material of the second substrate 122 is glass, dense ceramic, or silicon. When the material of the second substrate 122 is glass, the glass may be one of common glass, quartz glass, borosilicate glass, or photosensitive lithium aluminosilicate glass. In a specific implementation, the second substrate 122 is borosilicate glass. In another specific implementation, the second substrate 122 is photosensitive lithium aluminosilicate glass.

The material of the first substrate 121 and the material of the second substrate 122 may be the same or may be different. The first substrate 121 and the second substrate 122 may be randomly combined. For example, the first substrate 121 is porous ceramic, and the second substrate 122 is a dense substrate. In another example, the first substrate 121 is porous ceramic, and the second substrate 122 is porous ceramic. In another example, the first substrate 121 is a dense substrate, and the second substrate 122 is porous ceramic. In another example, the first substrate 121 is a dense substrate, and the second substrate 122 is a dense substrate.

The following describes the heating assembly 12 in detail by using an example in which the first substrate 121 is a dense substrate and the second substrate 122 is a dense substrate.

The first substrate 121 is a dense substrate, and the first substrate 121 includes a plurality of first micropores 1213 running through the first surface 1211 and the second surface 1212. The second substrate 122 is a dense substrate, and the second substrate 122 includes a plurality of second micropores 1223 running through the third surface 1221 and the fourth surface 1222. The plurality of first micropores 1213 and the plurality of second micropores 1223 all include capillary force. The plurality of first micropores 1213 guide the aerosol-generation substrate from the liquid absorbing surface of the first substrate 121 to the gap 123 through the capillary force thereof; and the plurality of second micropores 1223 guide the aerosol-generation substrate from the gap 123 to the vaporization surface of the second substrate 122 through the capillary force thereof.

It may be understood that, when the first substrate 121 is porous ceramic, the first substrate 121 guides the aerosol-generation substrate from the liquid absorbing surface of the first substrate 121 to the gap 123 through capillary force thereof; and when the second substrate 122 is porous ceramic, the second substrate 122 guides the aerosol-generation substrate from the gap 123 to the vaporization surface of the second substrate 122 through capillary force thereof.

It may be understood that, the second substrate 122 is set to a dense substrate, and a plurality of second micropores 1223 running through the third surface 1221 and the fourth surface 1222 are provided on the second substrate 122, so that the plurality of second micropores communicate the plurality of first micropores 1213 of the first substrate 121 in a liquid guiding manner more easily, thereby helping improve the liquid supplying efficiency.

A height of the gap 123 is less than or equal to 200 μm, and the height of the gap 123 is a distance between the second surface 1212 and the third surface 1221. When the height of the gap 123 is greater than 200 μm, there is a risk of liquid leakage from the plurality of first micropores 1213 and/or the plurality of second micropores 1223, and there is a risk that bubbles are transversely merged to grow up. When the height of the gap 123 is excessively small, the gap 123 cannot well remove the bubbles entering through the plurality of second micropores 1223. In a specific implementation, the height of the gap 123 is less than or equal to 50 μm. In another specific implementation, the height of the gap 123 is less than or equal to 20 μm.

Through arrangement of the gap 123, transverse liquid supplement. Even if the bubbles are attached to the liquid absorbing surface of the first substrate 121 and cover some first micropores 1213, liquid supplying of the second substrate 122 is also not affected. Further, the height of the gap 123 is set to a range limiting the bubbles from growing up, so that bubbles separating from the plurality of second micropores 1223 can be hardly formed, and the bubbles are discharged from the vaporization surface during collapsing, thereby preventing large bubbles from being attached to the liquid absorbing surface of the first substrate 121 and affecting liquid supplying.

In this embodiment, as shown in FIG. 3*b*, the heating assembly 12 further includes a heating component 124, a positive electrode 128, and a negative electrode 129, where two ends of the heating component 124 are respectively electrically connected to the positive electrode 128 and the negative electrode 129. The positive electrode 128 and the negative electrode 129 are both arranged on the vaporization surface of the second substrate 122 to be electrically connected to the main unit 2. The heating component 124 may be a heating sheet, a heating film, or a heating mesh, provided that the aerosol-generation substrate can be heated and vaporized. The heating component 124 may be arranged on the vaporization surface of the second substrate 122 or may be buried inside the second substrate 122, which is specifically designed as required. In another implementation, the second substrate 122 includes a conductive function and can generate heat by itself, such as conductive ceramic generating heat by itself or glass including a conductive function, and the heating component 124 does not need to be additionally arranged in this case. That is, the heating component 124 is an optional structure.

When the heating component 124 is an additionally arranged component, a projection of the first substrate 121 on the vaporization surface totally covers the heating component 124, to ensure that a liquid supplying speed can meet a vaporization speed of the heating component 124, thereby achieving a relatively good vaporization effect.

Further, by arranging the first substrate 121 on one side of the second substrate 122 that is close to the liquid storage cavity 13, the first substrate 121 may insulate heat to some extent and prevent heat on the second substrate 122 from being conducted to the liquid storage cavity 13, thereby helping ensuring the taste consistency.

Referring to FIG. 3*b*, in this implementation, the plurality of second micropores 1223 are merely provided on a part of the surface of the second substrate 122 in an array. Specifically, a microporous array region 1224 and a blank region 1225 provided surrounding a periphery of the microporous array region 1224 are provided on the second substrate 122, where the microporous array region 1224 includes the plurality of second micropores 1223; the heating component 124 is arranged in the microporous array region 1224 to heat and vaporize the aerosol-generation substrate; and the positive electrode 128 and the negative electrode 129 are arranged in the blank region 1225 on the vaporization surface (the fourth surface 1222), to ensure the stability of the electrical connection between the positive electrode 128 and the negative electrode 129.

By providing the microporous array region 1224 and the blank region 1225 provided surrounding the periphery of the microporous array region 1224 on the second substrate 122, it may be understood that, no second micropore 1223 is provided in the blank region 1225, and a number of second micropores 1223 on the second substrate 122 is reduced. Therefore, the intensity of the second substrate 122 is improved, and production costs for providing the second micropores 1223 on the second substrate 122 are reduced. The microporous array region 1224 in the second substrate 122 serves as a vaporization region and covers the heating component 124 and a region around the heating component 124, that is, basically covers regions reaching a temperature for vaporizing the aerosol-generation substrate, so that the thermal efficiency is fully utilized.

It may be understood that, only when a size of a region around the microporous array region 1224 of the second substrate 122 in this application is greater than a pore size of each of the plurality of second micropores 1223, can the region be referred to as the blank region 1225. That is, the blank region 1225 in this application in which second micropores 1223 can be formed but no second micropore 1223 is formed, rather than a region around the microporous array region 1224 and in which second micropores 1223 cannot be formed. In an embodiment, it is considered that a blank region 1225 is provided in a circumferential direction of the microporous array region 1224 only when a gap between a second micropore 1223 that is closest to a touchline of the second substrate 122 and the touchline of the second substrate 122 is greater than the pore size of each of the plurality of second micropores 1223.

The plurality of first micropores 1213 are provided in an entire surface, or the plurality of first micropores 1213 are provided in a part of the surface of the first substrate 121, which may be designed as required. Optionally, referring to FIG. 3*c*, a microporous array region 1214 and a blank region 1215 provided surrounding a periphery of the microporous array region 1214 are provided on the first substrate 121, where the microporous array region 1214 includes the plurality of first micropores 1213.

A shape of the first substrate 121 and a shape of the second substrate 122 may be a plate, a cylinder, or an arc, which are specifically designed as required; and the shape of the first substrate 121 and the shape of the second substrate 122 are set in a matching manner, provided that the gap 123 can be formed between the first substrate 121 and the second substrate 122. For example, the first substrate 121 and the second substrate 122 of the heating assembly 12 provided in FIG. 3*a* are both in a shape of a plate. Shapes and sizes of the first substrate 121 and the second substrate 122 may be the same or may be different. In this embodiment, as shown in FIG. 3*a*, the shapes and the sizes of the first substrate 121 and the second substrate 122 are the same, and projections thereof totally overlap with each other.

The first substrate 121 and the second substrate 122 may be set to be in a regular shape, such as a rectangular plate or a circular plate. The plurality of first micropores 1213 provided on the first substrate 121 are arranged in an array. That is, the plurality of first micropores 1213 provided on the first substrate 121 are regularly arranged, and distances between centers of adjacent first micropores 1213 among the plurality of first micropores 1213 are the same. The plurality of second micropores 1223 provided on the second substrate 122 are arranged in an array. That is, the plurality of second micropores 1223 provided on the second substrate 122 are regularly arranged, and distances between centers of adjacent second micropores 1223 among the plurality of second micropores 1223 are the same.

An extending direction of each of the plurality of first micropores 1213 may be parallel to a thickness direction of the first substrate 121 or may form an angle with the thickness direction of the first substrate 121, where the angle ranges from 80 degrees to 90 degrees. A cross section of each of the plurality of first micropores 1213 may be a circle, and a longitudinal section thereof may be a rectangle. An extending direction of each of the plurality of second micropores 1223 may be parallel to a thickness direction of the second substrate 122 or may form an angle with the thickness direction of the second substrate 122, where the angle ranges from 80 degrees to 90 degrees. A cross section of each of the plurality of second micropores 1223 may be a circle, and a longitudinal section thereof may be a rectangle. Shapes of the longitudinal sections and the extending directions of each of the plurality of first micropores 1213 and each of the plurality of second micropores 1223 may be designed as required. In this embodiment, each of the plurality of first micropores 1213 or each of the plurality of second micropores 1223 is a straight through hole parallel to the thickness direction of the first substrate 121 or the second substrate 122. That is, a central axis of each of the plurality of first micropores 1213 is perpendicular to the first surface 1211, and a central axis of each of the plurality of second micropores 1223 is perpendicular to the third surface 1221.

In this implementation, a projection of a region on the first substrate 121 where the plurality of first micropores 1213 are provided on the second substrate 122 totally covers a region on the second substrate 122 where the plurality of second micropores 1223 are provided, to ensure that a liquid supplying speed can meet a vaporization speed of the heating component 124 arranged on the vaporization surface of the second substrate 122, thereby achieving a relatively good vaporization effect.

A pore size of each of the plurality of first micropores 1213 on the first substrate 121 ranges from 1 μm to 100 μm. When the pore size of each of the plurality of first micropores 1213 is less than 1 μm, the liquid supplying requirement cannot be met, leading to a decrease in an amount of aerosols; and when the pore size of each of the plurality of first micropores 1213 is greater than 100 μm, the aerosol-generation substrate may easily leak out from the plurality of first micropores 1213 to cause liquid leakage, leading to a decrease in the vaporization efficiency. It may be understood that, the pore size of each of the plurality of first micropores 1213 is selected according to an actual requirement.

A pore size of each of the plurality of second micropores 1223 on the second substrate 122 ranges from 1 μm to 100 μm. When the pore size of each of the plurality of second micropores 1223 is less than 1 μm, the liquid supplying requirement cannot be met, leading to a decrease in an amount of aerosols; and when the pore size of each of the plurality of second micropores 1223 is greater than 100 μm, the aerosol-generation substrate may easily leak out from the plurality of second micropores 1223 to cause liquid leakage, leading to a decrease in the vaporization efficiency. Optionally, the pore size of each of the plurality of second micropores 1223 ranges from 20 μm to 50 μm. It may be understood that, the pore size of each of the plurality of second micropores 1223 is selected according to an actual requirement.

Optionally, the pore size of each of the plurality of first micropores 1213 is greater than the pore size of each of the plurality of second micropores 1223 (as shown in FIG. 3*a*), so that capillary force of each of the plurality of second micropores 1223 is greater than capillary force of each of the plurality of first micropores 1213, and the aerosol-generation substrate can flow from the gap 123 to the vaporization surface of the second substrate 122. Because each of the plurality of first micropores 1213 also includes capillary force, when the inhalation opening 15 is used downward, liquid reflux may be prevented, thereby preventing insufficient liquid supplying.

A thickness of the second substrate 122 ranges from 0.1 mm to 1 mm. When the thickness of the second substrate 122 is greater than 1 mm, the liquid supplying requirement cannot be met, leading to a decrease in the amount of aerosols, a great heat loss, and high costs for providing the plurality of second micropores 1223; and when the thickness of the second substrate 122 is less than 0.1 mm, the intensity of the second substrate 122 cannot be ensured, which is not conducive to improve the performance of the electronic vaporization device. Optionally, the thickness of the second substrate 122 ranges from 0.2 mm to 0.5 mm. It may be understood that, the thickness of the second substrate 122 is selected according to an actual requirement.

A thickness of the first substrate 121 ranges from 0.1 mm to 1 mm. Optionally, the thickness of the first substrate 121 is less than the thickness of the second substrate 122. The thickness of the first substrate 121 is a distance between the first surface 1211 and the second surface 1212, and the thickness of the second substrate 122 is a distance between the third surface 1221 and the fourth surface 1222.

A ratio of the thickness of the second substrate 122 to the pore size of each of the plurality of second micropores 1223 ranges from 20:1 to 3:1, to improve a liquid supplying capability. When the ratio of the thickness of the second substrate 122 to the pore size of each of the plurality of second micropores 1223 is greater than 20:1, the aerosol-generation substrate supplied through the capillary force of each of the plurality of second micropores 1223 can hardly meet a vaporization required amount of the heating component 124, which easily leads to dry burning and a decrease in an amount of aerosols generated in single vaporization; and when the ratio of the thickness of the second substrate 122 to the pore size of each of the plurality of second micropores 1223 is less than 3:1, the aerosol-generation substrate may easily leak out from each of the plurality of second micropores 1223 to cause a waste, leading to a decrease in the vaporization efficiency and a decrease in a total amount of aerosols. Optionally, the ratio of the thickness of the second substrate 122 to the pore size of each of the plurality of second micropores 1223 ranges from 15:1 to 5:1.

A ratio of a distance between centers of two adjacent second micropores 1223 to the pore size of each of the plurality of second micropores 1223 ranges from 3:1 to 1.5:1, so that the intensity of the second substrate 122 is improved as much as possible while causing the plurality of second micropores 1223 on the second substrate 122 to meet the liquid supplying capability. Optionally, the ratio of the distance between centers of two adjacent second micropores 1223 to the pore size of each of the plurality of second micropores 1223 ranges from 3:1 to 2:1. Further optionally, the ratio of the distance between centers of two adjacent second micropores 1223 to the pore size of each of the plurality of second micropores 1223 ranges from 3:1 to 2.5:1.

In this embodiment, the heating assembly 12 further includes a spacer 125. The spacer 125 is arranged between the second surface 1212 of the first substrate 121 and the third surface 1221 of the second substrate 122 and is arranged at an edge of the first substrate 121 and/or an edge of the second substrate 122, so that the first substrate 121 and the second substrate 122 are spaced to form the gap 123.

In an implementation, a height of the gap 123 is the same in a direction parallel to the first substrate 121. That is, the second surface 1212 and the third surface 1221 are arranged parallel to each other. For example, two equal-height spacers 125 are arranged between the second surface 1212 and the third surface 1221, and the two equal-height spacers 125 are arranged at edges of two opposite ends of the first substrate 121 and the second substrate 122 (as shown in FIG. 3*a*); or an equal-height annular spacer 125 such as a plastic frame is arranged between the second surface 1212 and the third surface 1221.

Figure 3D:
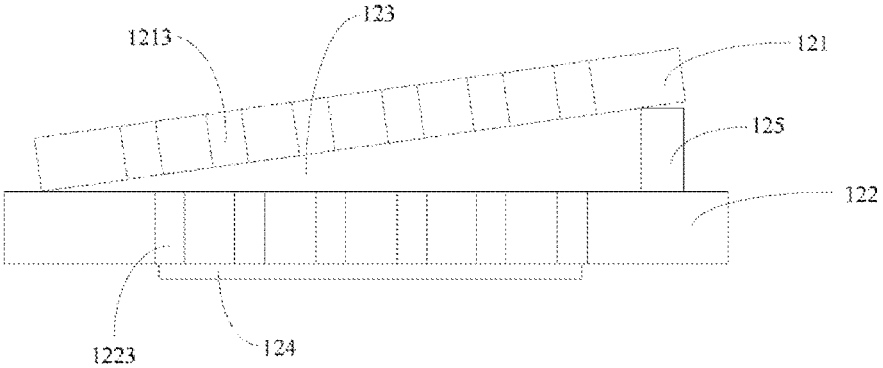
FIG. 3*d* is a schematic structural diagram of another implementation of a spacer in the heating assembly provided in FIG. 3*a;*

Referring to FIG. 3*d*, FIG. 3*d* is a schematic structural diagram of another implementation of a spacer in the heating assembly provided in FIG. 3*a*.

In another implementation, the height of the gap 123 is gradually increased in a direction parallel to the first substrate 121. For example, the height of the gap 123 is gradually increased in a length direction, a width direction, or a diagonal direction of the first substrate 121. That is, the second surface 1212 and the third surface 1221 are arranged not parallel to each other. Optionally, the height of the gap 123 is gradually increased from zero. For example, only one spacer 125 is arranged between the second surface 1212 and the third surface 1221, the spacer 125 is arranged at an edge of one end of the first substrate 121 and at edge of one end of the second substrate 122 (as shown in FIG. 3*d*), and an edge of the other end of the first substrate 121 is in contact with an edge of the other end of the second substrate 122. In another example, two spacers 125 with different heights are arranged at edges of two opposite ends of the first substrate 121 and the second substrate 122. By providing a gap 123 whose height is uneven, liquid in the gap 123 easily transversely flows in the gap 123, so that the bubbles in the gap 123 may be prevented from blocking an end opening of each of the plurality of first micropores 1213 or an end opening of each of the plurality of second micropores 1223, the bubbles can be discharged better, and the impact of the bubbles on the liquid supplying speed is reduced.

The following describes a structure of the spacer 125 in a solution that the height of the gap 123 is the same in the direction parallel to the first substrate 121 in detail.

Specifically, when a projection of the first substrate 121 on the second substrate 122 totally overlaps with the second substrate 122, that is, the structures and sizes of the first substrate 121 and the second substrate 122 are totally the same, the spacer 125 is arranged at an edge of the first substrate 121 and an edge of the second substrate 122 (as shown in FIG. 3*a*). When the projection of the first substrate 121 on the second substrate 122 totally covers the second substrate 122, that is, the size of the first substrate 121 is greater than the size of the second substrate 122, the spacer 125 is arranged at an edge of the second substrate 122 and a position close to a side edge of the first substrate 121. When a projection of the second substrate 122 on the first substrate 121 totally covers the first substrate 121, that is, the size of the second substrate 122 is greater than the size of the first substrate 121, the spacer 125 is arranged at an edge of the first substrate 121 and a position close to a side edge of the second substrate 122. That is, an arrangement position of the spacer 125 may be determined according to specific size arrangement of the first substrate 121 and the second substrate 122, provided that the first substrate 121, the second substrate 122, and the spacer 125 can encircle to form the gap 123.

The spacer 125 may be arranged in a circumferential direction of the first substrate 121 and in a circumferential direction of the second substrate 122, that is, the spacer 125 is an annular structure, to prevent the aerosol-generation substrate in the gap 123 from leaking out. There may also be a plurality of spacers 125 arranged at intervals in the circumferential direction of the first substrate 121 and the circumferential direction of the second substrate 122, and the circumferential direction of the first substrate 121 and the circumferential direction of the second substrate 122 are sealed through a seal member 126.

In an implementation, the spacer 125 is an independently arranged gasket, the gasket is detachably connected to the first substrate 121 and the second substrate 122, and the gasket is an annular structure. Specific operations are as follows: the plurality of first micropores 1213 are formed on the first substrate 121, the plurality of second micropores 1223 are formed on the second substrate 122, and the gasket is then arranged between the first substrate 121 and the second substrate 122. Specifically, the gasket is arranged between the blank region 1215 on the first substrate 121 and the blank region 1225 on the second substrate 122. For example, the spacer 125 may be a silicone frame or a plastic frame.

In another implementation, the spacer 125 is a support column or a support frame fixed to the second surface 1212 of the first substrate 121 and/or the third surface 1221 of the second substrate 122, and the support column or the support frame is fixed to the second surface 1212 of the first substrate 121 and/or the third surface 1221 of the second substrate 122 in a clamping or soldering manner. Specific operations are as follows: the plurality of first micropores 1213 are formed on the first substrate 121, the plurality of second micropores 1223 are formed on the second substrate 122, and the support column or the support frame is then integrated with the first substrate 121 and the second substrate 122 in a soldering or clamping manner. For example, the first substrate 121 and the second substrate 122 are glass plates, glass powder is coated on an edge of the first substrate 121, and after the second substrate 122 is covered on the first substrate, the glass powder is sintered through laser into glass to fix the support column or the support frame to the first substrate 121 and the second substrate 122.

In still another implementation, the spacer 125 is a protrusion integrally formed with the first substrate 121 and/or the second substrate 122. If the spacer 125 is a protrusion integrally formed with the first substrate 121, the plurality of first micropores 1213 are formed on the first substrate 121, the plurality of second micropores 1223 are formed on the second substrate 122, and the second substrate 122 is then overlapped on the protrusion to form the gap 123. If the spacer 125 is a protrusion integrally formed with the second substrate 122, the plurality of first micropores 1213 are formed on the first substrate 121, the plurality of second micropores 1223 are formed on the second substrate 122, and the first substrate 121 is then overlapped on the protrusion to form the gap 123. For example, etching is performed on the second surface 1212 of the first substrate 121 to form a groove, a side wall of the groove serves as the spacer 125, and the plurality of first micropores 1213 are formed on a bottom wall of the groove. The third surface 1221 of the second substrate 122 is a plane, the third surface 1221 of the second substrate 122 is overlapped on an end surface of the side wall of the groove on the second surface 1212, that is, the third surface 1221 of the second substrate 122 is attached to the second surface 1212 of the first substrate 121, and the third surface 1221 cooperates with the groove to form the gap 123. If a bottom surface of the groove is explained as the second surface 1212, the side wall of the groove may be explained as a protrusion on the second surface 1212.

The heating assembly 12 further includes a seal member 126, the seal member 126 includes a liquid supplying hole 1261, and the liquid supplying hole 1261 is in fluid communication with the liquid storage cavity 13 through a fluid channel 114. The first substrate 121 and/or the second substrate 122 are embedded in the liquid supplying hole 1261, that is, the seal member 126 is configured to seal a periphery of the first substrate 121 and/or a periphery of the second substrate 122, to prevent liquid leakage. Optionally, the first substrate 121 and the second substrate 122 are arranged in the liquid supplying hole 1261. When the seal member 126 covers the periphery of the second substrate 122, the seal member 126 does not block the heating component 124, and the liquid supplying hole 1261 can totally expose the heating component 124. In this embodiment, a hole wall of the liquid supplying hole 1261 is provided with an annular mounting groove (not shown in the figure), and an edge of the first substrate 121 and/or an edge of the second substrate 122 are embedded in the annular mounting groove.

Figure 4:
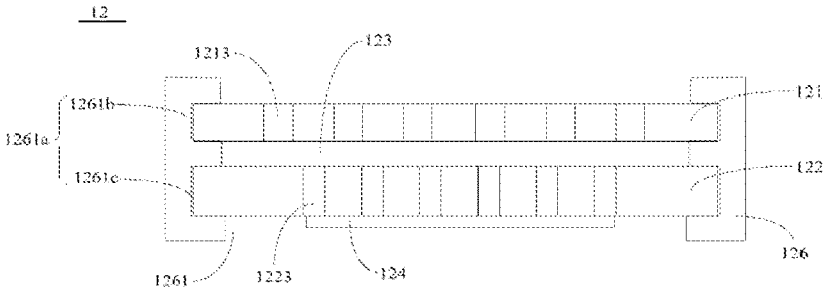
FIG. 4 is a schematic structural diagram of a second embodiment of a heating assembly according to this application.

Referring to FIG. 4, FIG. 4 is a schematic structural diagram of a second embodiment of a heating assembly according to this application.

A difference between the second embodiment of the heating assembly 12 and the first embodiment of the heating assembly 12 lies in that: in the first embodiment of the heating assembly 12, the gap 123 between the first substrate 121 and the second substrate 122 is kept through the spacer 125, but in the second embodiment of the heating assembly 12, the gap 123 between the first substrate 121 and the second substrate 122 is kept through the seal member 126, and the spacer 125 does not need to be additionally arranged. In the second embodiment of the heating assembly 12, in addition to the difference of the manner for keeping the gap 123 from the first embodiment of the heating assembly 12, arrangement manners of other structures are all the same as those in the first embodiment of the heating assembly 12, and details are not described herein again.

In the second embodiment of the heating assembly 12, a fixing structure 1261*a* is arranged on the hole wall of the liquid supplying hole 1261 of the seal member 126, to fix the first substrate 121 and/or the second substrate 122 and cause the first substrate 121 and the second substrate 122 to be spaced to form the gap 123. A specific arrangement manner of the fixing structure 1261*a* is as follows.

In an implementation, a first mounting groove 1261*b* and a second mounting groove 1261*c* are spaced on the hole wall of the liquid supplying hole 1261, the first mounting groove 1261*b* and the second mounting groove 1261*c* are both annular grooves, and the first mounting groove 1261*b* and the second mounting groove 1261*c* serve as the fixing structure 1261*a*. The first mounting groove 1261*b* and the second mounting groove 1261*c* share one side wall. The periphery of the first substrate 121 is embedded in the first mounting groove 1261*b*, the periphery of the second substrate 122 is embedded in the second mounting groove 1261*c*, and the side wall shared by the first mounting groove 1261*b* and the second mounting groove 1261*c* cause the first substrate 121 and the second substrate 122 to keep spaced to form the gap 123 (as shown in FIG. 4).

Figure 5A:
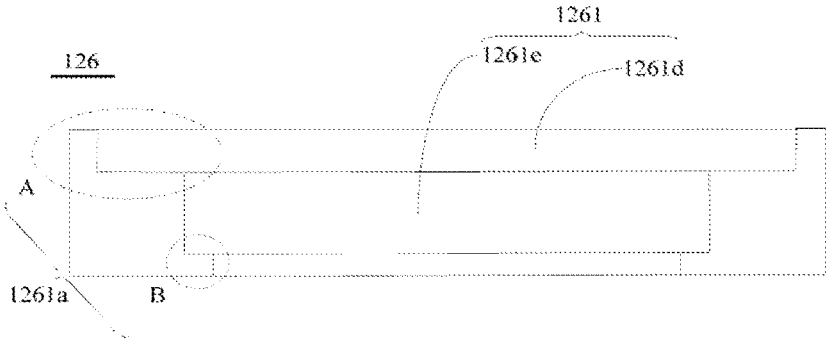
FIG. 5*a* is a schematic structural diagram of another implementation of a seal member in a second embodiment of a heating assembly according to this application.
Figure 5B:
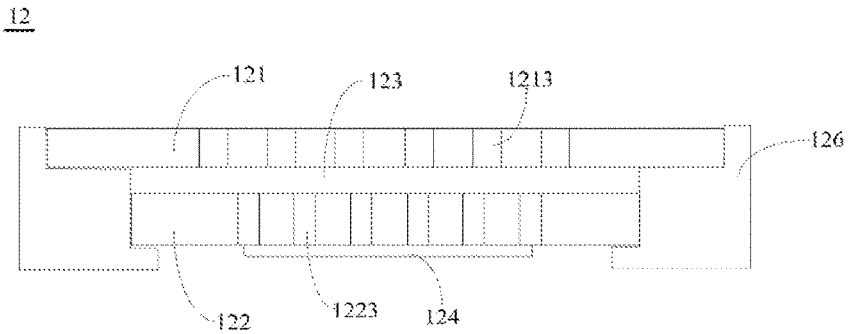
FIG. 5*b* is a schematic structural diagram of assembly of the seal member provided in FIG. 5*a* with a first dense substrate and a second substrate.

Referring to FIG. 5*a* and FIG. 5*b*, FIG. 5*a* is a schematic structural diagram of another implementation of a seal member in a second embodiment of a heating assembly according to this application, and FIG. 5*b* is a schematic structural diagram of assembly of the seal member provided in FIG. 5*a* with a first dense substrate and a second substrate.

In an implementation, the liquid supplying hole 1261 includes a first liquid supplying hole 1261*d* and a second liquid supplying hole 1261*e*, a pore size of the first liquid supplying hole 1261*d* is greater than a pore size of the second liquid supplying hole 1261*e*, so that a step structure A is formed between the first liquid supplying hole 1261*d* and the second liquid supplying hole 1261*e*, and an annular protrusion B is arranged on a hole wall of the second liquid supplying hole 1261*e*. The step structure A and the annular protrusion B serve as the fixing structure 1261*a*. The periphery of the first substrate 121 is overlapped on a step surface of the step structure, that is, the periphery of the first substrate 121 is overlapped on a connection surface of the first liquid supplying hole 1261*d* and the second liquid supplying hole 1261*e*. The periphery of the second substrate 122 is overlapped on the annular protrusion B, and the gap 123 is formed between the first substrate 121 and the second substrate 122. It may be understood that, the fixing of the second substrate 122 and formation of the gap 123 may also be implemented through interference fit between the second substrate 122 and the second liquid supplying hole 1261*e*.

Figure 6A:
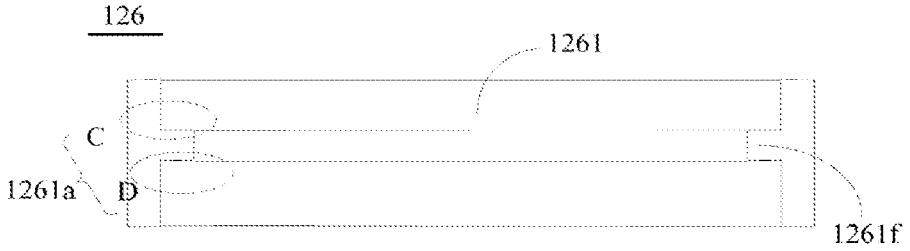
FIG. 6*a* is a schematic structural diagram of still another implementation of a seal member in a second embodiment of a heating assembly according to this application.
Figure 6B:
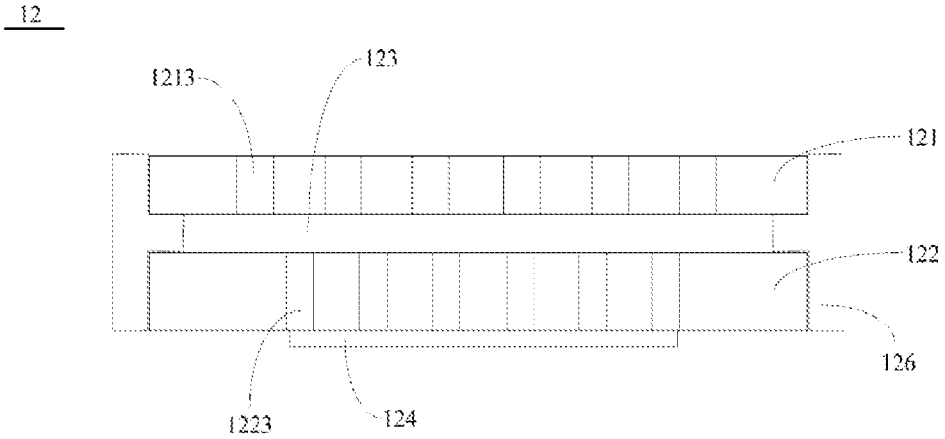
FIG. 6*b* is a schematic structural diagram of assembly of the seal member provided in FIG. 6*a* with a first dense substrate and a second substrate.

Referring to FIG. 6*a* and FIG. 6*b*, FIG. 6*a* is a schematic structural diagram of still another implementation of a seal member in a second embodiment of a heating assembly according to this application, and FIG. 6*b* is a schematic structural diagram of assembly of the seal member provided in FIG. 6*a* with a first dense substrate and a second substrate.

In an implementation, a protrusion 1261*f* is arranged on the hole wall of the liquid supplying hole 1261 of the seal member 126, to form a first step structure C and a second step structure D. The protrusion 1261*f* and the seal member 126 are an integrally formed structure. The first step structure C and the second step structure D serve as the fixing structure 1261*a*. The first substrate 121 is arranged on a step surface of the first step structure C, the second substrate 122 is arranged on a step surface of the second step structure D, and the gap 123 is formed between the first substrate 121 and the second substrate 122.

Figure 7A:
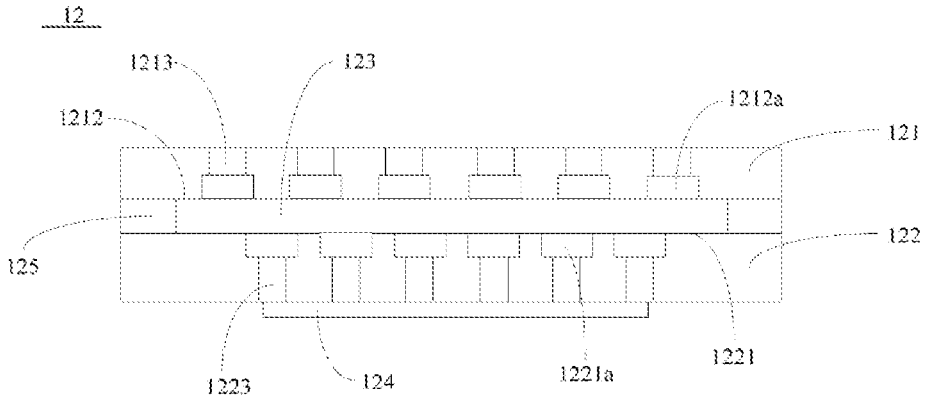
FIG. 7*a* is a schematic structural diagram of a third embodiment of a heating assembly according to this application.
Figure 7B:
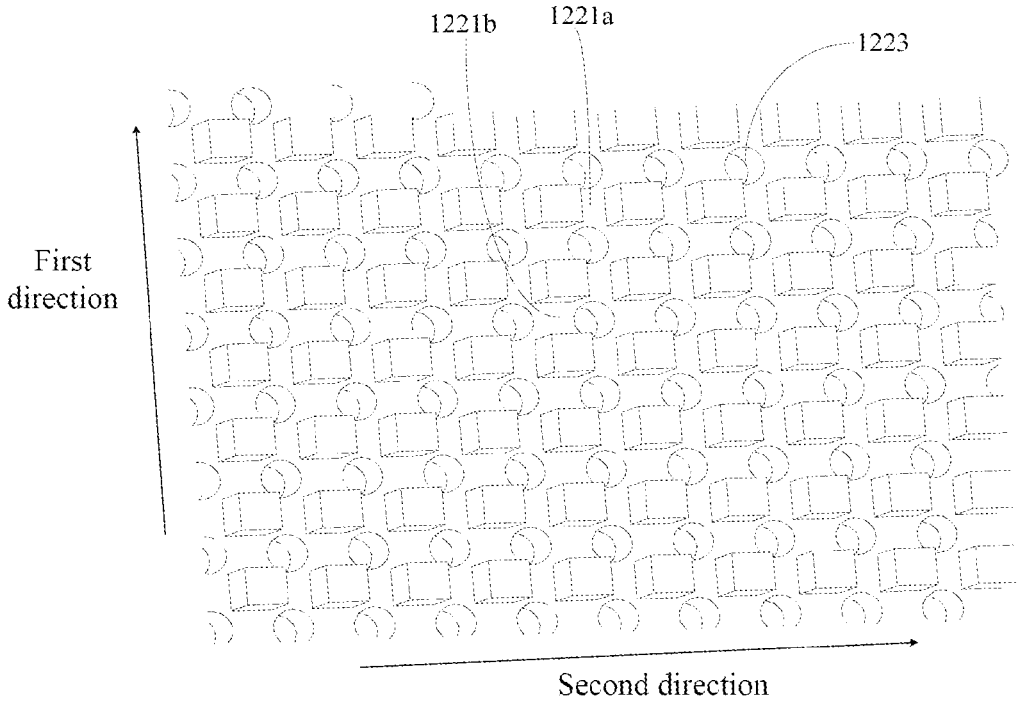
FIG. 7*b* is a schematic partial structural diagram of a second substrate in the heating assembly provided in FIG. 7*a* viewing from one side of a third surface.

Referring to FIG. 7*a* and FIG. 7*b*, FIG. 7*a* is a schematic structural diagram of a third embodiment of a heating assembly according to this application, and FIG. 7*b* is a schematic partial structural diagram of a second substrate in the heating assembly provided in FIG. 7*a* viewing from one side of a third surface.

A difference between the third embodiment of the heating assembly 12 and the first embodiment of the heating assembly 12 lies in that: manners in which the first substrate 121 and/or the second substrate 122 form the flow channel are different, and arrangement manners of other structures are all the same as those in the first embodiment of the heating assembly 12, which are not described herein again.

Different from the first embodiment of the heating assembly 12 that the flow channel is formed through the gap 123, in the third embodiment of the heating assembly 12, a plurality of first grooves 1221*a* extending in a first direction and a plurality of second grooves 1221*b* extending in a second direction are provided on the third surface 1221, the plurality of first grooves 1221*a* and the plurality of second grooves 1221*b* are provided in an intersecting manner, and the plurality of first grooves 1221*a* and the plurality of second grooves 1221*b* form the flow channel. In this embodiment, the first direction is perpendicular to the second direction.

It may be understood that, in some other embodiments, only the plurality of first grooves 1221*a* extending in the first direction or only the plurality of second grooves 1221*b* extending in the second direction are provided, that is, adjacent second micropores 1223 are only communicated in one direction. The plurality of first grooves 1221*a* and/or the plurality of second grooves 1221*b* include capillary force, and the aerosol-generation substrate may be guided in a transverse direction, so that the aerosol-generation substrate enters the plurality of second micropores 1223 uniformly, thereby playing a role of transverse liquid supplement. The transverse direction refers to a direction not parallel to the extending direction of each of the plurality of second micropores 1223, such as a direction perpendicular to the central axis of each of the plurality of second micropores 1223.

Further, by providing the plurality of first grooves 1221*a* and the plurality of second grooves 1221*b* intersecting with each other on the third surface 1221, no matter the first substrate 121 is in contact with the second substrate 122 or the first substrate 121 and the second substrate 122 are spaced, the first substrate 121 can be prevented from covering the plurality of second micropores 1223 on the second substrate 122, thereby ensuring that the aerosol-generation substrate can flow to the vaporization surface and preventing dry burning. In addition, the plurality of first grooves 1221*a* and the plurality of second grooves 1221*b* may further implement transverse liquid supplement of the aerosol-generation substrate, to further prevent dry burning.

The plurality of second micropores 1223 are distributed in an array, each of the plurality of first grooves 1221*a* corresponds to one row or a plurality of rows of second micropores 1223, and each of the plurality of second grooves 1221*b* corresponds to one column or a plurality of columns of second micropores 1223, which are specifically designed as required. In this embodiment, each of the plurality of first grooves 1221*a* corresponds to one row of second micropores 1223, and each of the plurality of second grooves 1221*b* corresponds to one column of second micropores 1223 (as shown in FIG. 7*b*).

A ratio of a depth to a width of each of the plurality of first grooves 1221*a* ranges from 0 to 20. When the ratio of the depth to the width of each of the plurality of first grooves 1221*a* is greater than 20, the capillary force included by the plurality of first grooves 1221*a* cannot achieve a relatively good transverse liquid supplement effect. In a specific implementation, the ratio of the depth to the width of each of the plurality of first grooves 1221*a* ranges from 1 to 5.

A ratio of a depth to a width of each of the plurality of second grooves 1221*b* ranges from 0 to 20. When the ratio of the depth to the width of each of the plurality of second grooves 1221*b* is greater than 20, the capillary force included by the plurality of second grooves 1221*b* cannot achieve a relatively good transverse liquid supplement effect. In a specific implementation, the ratio of the depth to the width of each of the plurality of second grooves 1221*b* ranges from 1 to 5.

Figure 7C:
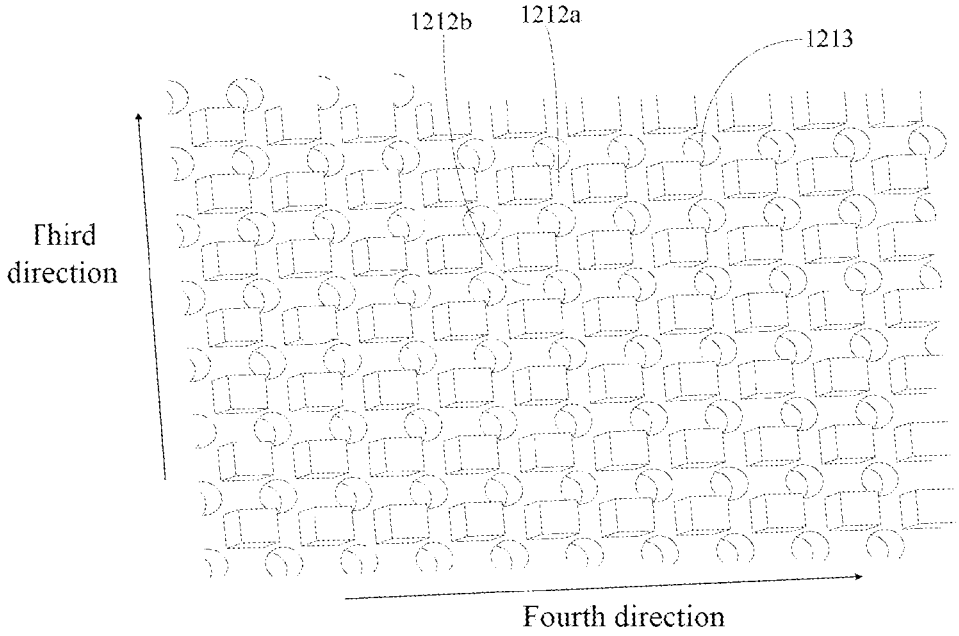
FIG. 7*c* is a schematic partial structural diagram of a first substrate in the heating assembly provided in FIG. 7*a* viewing from one side of a second surface.

Referring to FIG. 7*c*, FIG. 7*c* is a schematic partial structural diagram of a first substrate in the heating assembly provided in FIG. 7*a* viewing from one side of a second surface.

Further, a plurality of third grooves 1212*a* extending in a third direction and a plurality of fourth grooves 1212*b* extending in a fourth direction are provided on the second surface 1212, and the plurality of third grooves 1212*a* and the plurality of fourth grooves 1212*b* are provided in an intersecting manner; and the plurality of first grooves 1221*a*, the plurality of second grooves 1221*b*, the plurality of third grooves 1212*a*, and the plurality of fourth grooves 1212*b* together form the flow channel. In this embodiment, the third direction is perpendicular to the fourth direction; and the third direction is the same as the first direction, and the fourth direction is the same as the second direction.

It may be understood that, in some other embodiments, only the plurality of third grooves 1212*a* extending in the third direction or only the plurality of fourth grooves 1212*b* extending in the fourth direction are provided, that is, adjacent first micropores 1213 are only communicated in one direction. The plurality of third grooves 1212*a* and/or the plurality of fourth grooves 1212*b* include capillary force, and the aerosol-generation substrate may be guided in a transverse direction, so that the aerosol-generation substrate enters the plurality of second micropores 1223 uniformly, thereby playing a role of transverse liquid supplement.

The plurality of first micropores 1213 are distributed in an array, each of the plurality of third grooves 1212*a* corresponds to one row or a plurality of rows of first micropores 1213, and each of the plurality of fourth grooves 1212*b* corresponds to one column or a plurality of columns of first micropores 1213, which are specifically designed as required. In this embodiment, each of the plurality of third grooves 1212*a* corresponds to one row of first micropores 1213, and each of the plurality of fourth grooves 1212*b* corresponds to one column of first micropores 1213 (as shown in FIG. 7*c*).

A ratio of a depth to a width of each of the plurality of third grooves 1212*a* ranges from 0 to 20. When the ratio of the depth to the width of each of the plurality of third grooves 1212*a* is greater than 20, the capillary force included by the plurality of third grooves 1212*a* cannot achieve a relatively good transverse liquid supplement effect. In a specific implementation, the ratio of the depth to the width of each of the plurality of third grooves 1212*a* ranges from 0 to 5.

A ratio of a depth to a width of each of the plurality of fourth grooves 1212*b* ranges from 0 to 20. When the ratio of the depth to the width of each of the plurality of fourth grooves 1212*b* is greater than 20, the capillary force included by the plurality of fourth grooves 1212*b* cannot achieve a relatively good transverse liquid supplement effect. In a specific implementation, the ratio of the depth to the width of each of the plurality of fourth grooves 1212*b* ranges from 0 to 5.

Capillary force of the plurality of first grooves 1221*a* and the plurality of second grooves 1221*b* on the third surface 1221 is greater than capillary force of the plurality of third grooves 1212*a* and the plurality of fourth grooves 1212*b* on the second surface 1212.

It may be understood that, the plurality of third grooves 1212*a* and the plurality of fourth grooves 1212*b* on the second surface 1212 are optional structures, which are designed as required.

In an implementation, the second surface 1212 and the third surface 1221 are spaced to form the gap 123 (as shown in FIG. 7*a*). Specifically, the gap 123 may be formed through the spacer 125 (reference may be made to the first embodiment of the heating assembly 12), or the gap 123 may be formed through the seal member 126 (reference may be made to the second embodiment of the heating assembly 12), and details are not described herein again. That is, the gap 123, the plurality of first grooves 1221*a*, and the plurality of second grooves 1221*b* together form the flow channel; or the gap 123, the plurality of first grooves 1221*a*, the plurality of second grooves 1221*b*, the plurality of third grooves 1212*a*, and the plurality of fourth grooves 1212*b* together form the flow channel. The height of the gap 123 is a distance between the second surface 1212 and the third surface 1221.

In this case, the plurality of third grooves 1212*a* and the plurality of fourth grooves 1212*b* on the second surface 1212 are optional structures. When the plurality of third grooves 1212*a* and the plurality of fourth grooves 1212*b* intersecting with each other are provided on the second surface 1212, a liquid storage amount of the gap 123 may be increased. A main function of the first substrate 121 is to perform liquid intaking and block bubbles. In the direction parallel to the first substrate 121, the height of the gap 123 may be the same or may be gradually increased. When the height of the gap 123 is gradually increased in the direction parallel to the first substrate 121, in a direction that the height of the gap 123 is gradually decreased, the capillary force of the gap 123 is gradually increased, thereby facilitating flowing of the aerosol-generation substrate in the gap 123 and preventing bubbles from staying in the gap 123. That is, an uneven gap 123 can more facilitate transverse flowing of the aerosol-generation substrate in the gap 123, to better perform transverse liquid supplement and discharge the bubbles.

Because the plurality of first grooves 1221*a* and the plurality of second grooves 1221*b* include capillary force, so that transverse liquid supplement can be performed, and air-liquid separation may be ensured through the gap 123, thereby reducing the impact of the bubbles on liquid supplying. In addition, by providing the plurality of first grooves 1221*a* and the plurality of second grooves 1221*b* intersecting with each other on the third surface 1221, the aerosol-generation substrate in the gap 123 can be guided to the plurality of second micropores 1223, thereby facilitating liquid supplying. Specifically, during inhalation, air may enter the plurality of first grooves 1221*a* and the plurality of second grooves 1221*b* through the plurality of second micropores 1223, due to reasons such as surface tension, bubbles more tend to enter the gap 123, so that the plurality of first grooves 1221*a* and the plurality of second grooves 1221*b* are unblocked, thereby ensuring liquid supplying. In addition, large bubbles may be prevented from reaching the liquid absorbing surface and entering the liquid storage cavity 13 through the gap 123, and a liquid storage function of the gap 123 may ensure that the gap may not be burnt out for at least two times of inverse inhalation.

Figure 8:
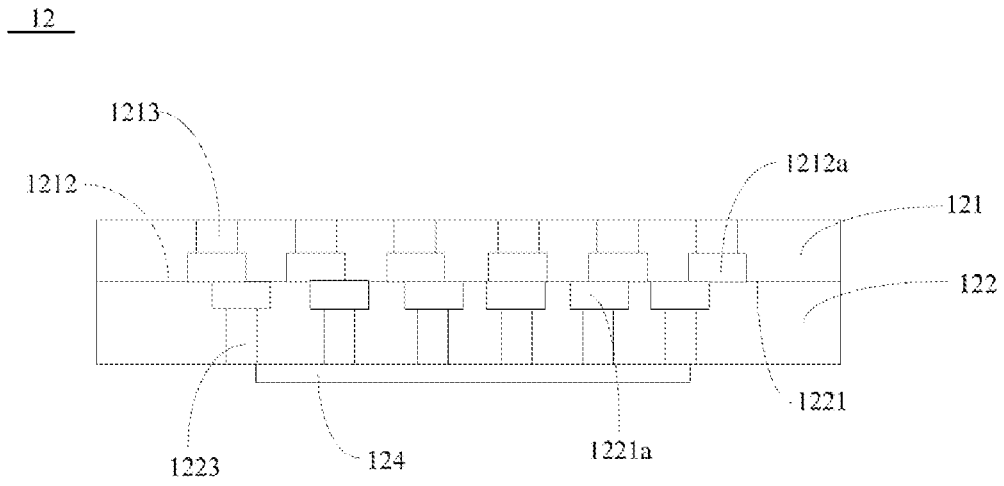
FIG. 8 is another schematic structural diagram of a third embodiment of a heating assembly according to this application.

Referring to FIG. 8, FIG. 8 is another schematic structural diagram of a third embodiment of a heating assembly according to this application.

In another implementation, the second surface 1212 is in contact with the third surface 1221 (as shown in FIG. 8). That is, the plurality of first grooves 1221*a*, the plurality of second grooves 1221*b*, the plurality of third grooves 1212*a*, and the plurality of fourth grooves 1212*b* together form the flow channel. The depth of each of the plurality of first grooves 1221*a* and the depth of each of the plurality of second grooves 1221*b* are greater than the depth of each of the plurality of third grooves 1212*a* and the depth of each of the plurality of fourth grooves 1212*b*. Optionally, the ratio of the depth to the width of each of the plurality of first grooves 1221*a* ranges from 2 to 5, and the ratio of the depth to the width of each of the plurality of second grooves 1221*b* ranges from 2 to 5. It may be understood that, the depth of each of the plurality of first grooves 1221*a* and the depth of each of the plurality of second grooves 1221*b* are greater than the depth of each of the plurality of third grooves 1212*a* and the depth of each of the plurality of fourth grooves 1212*b*, and capillary force of each of the plurality of first grooves 1221*a* and capillary force of each of the plurality of second grooves 1221*b* are greater than capillary force of each of the plurality of third grooves 1212*a* and capillary force of each of the plurality of fourth grooves 1212*b*. The depth of each of the plurality of first grooves 1221*a* and the depth of each of the plurality of second grooves 1221*b* cannot be excessively great, otherwise, a phenomenon of "layered" may occur during transverse liquid supplement. A flow speed of liquid close to a groove bottom is high, and a flow speed of liquid in a direction away from the groove bottom is increasingly low, so that there is a risk of blocked bubbles, and the bubbles may be even stuck in each of the plurality of first grooves 1221*a*.

By providing the plurality of third grooves 1212*a* and the plurality of fourth grooves 1212*b* intersecting with each other on the second surface 1212, a liquid storage amount between the first substrate 121 and the second substrate 122 may be increased, and the first substrate 121 may be prevented from blocking the plurality of second micropores 1223 when the first substrate 121 is in contact with the second substrate 122.

In other implementations, the communication between the plurality of first micropores 1213 and the plurality of second micropores 1223 may be implemented by causing the central axis of each of the plurality of first micropores 1213 to overlap with the central axis of each of the plurality of second micropores 1223 or causing end openings of the plurality of first micropores 1213 to at least partially overlap with end openings of the plurality of second micropores 1223, to prevent the first substrate 121 from blocking the plurality of second micropores 1223 when the first substrate 121 is in contact with the second substrate 122. In this case, the plurality of third grooves 1212*a* and the plurality of fourth grooves 1212*b* intersecting with each other may not need to be provided on the second surface 1212.

Figure 9A:
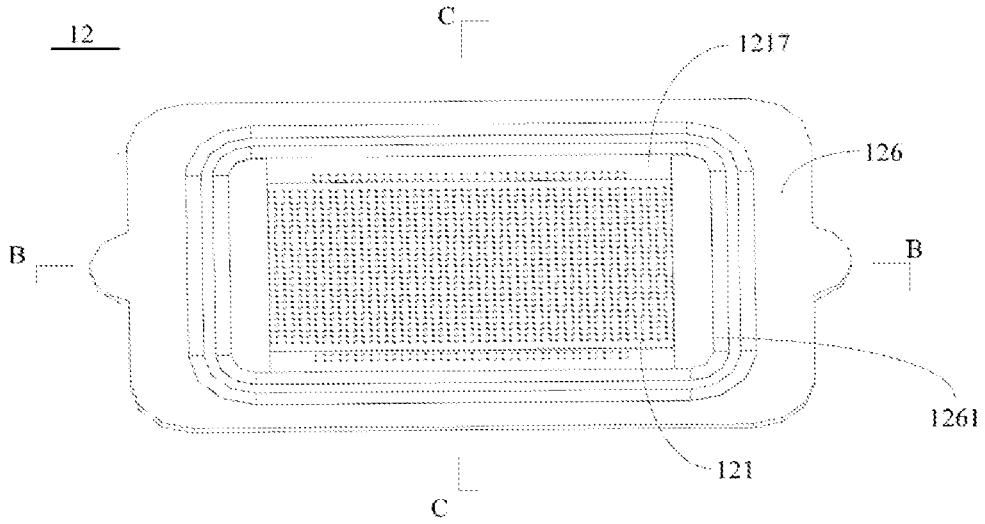
FIG. 9*a* is a schematic top structural view of a fourth embodiment of a heating assembly according to this application.
Figure 9B:
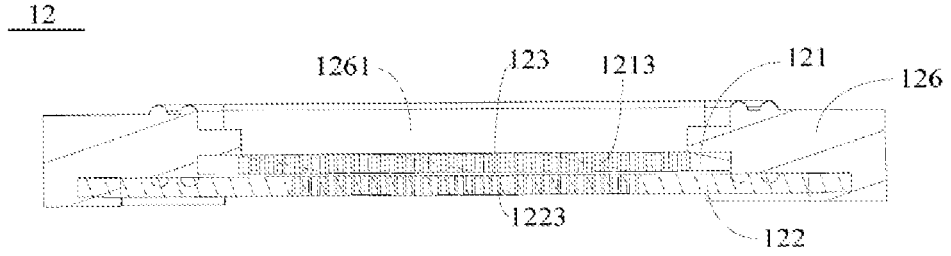
FIG. 9*b* is a schematic cross-sectional view of the heating assembly provided in FIG. 9*a* in a direction B-B.
Figure 9C:
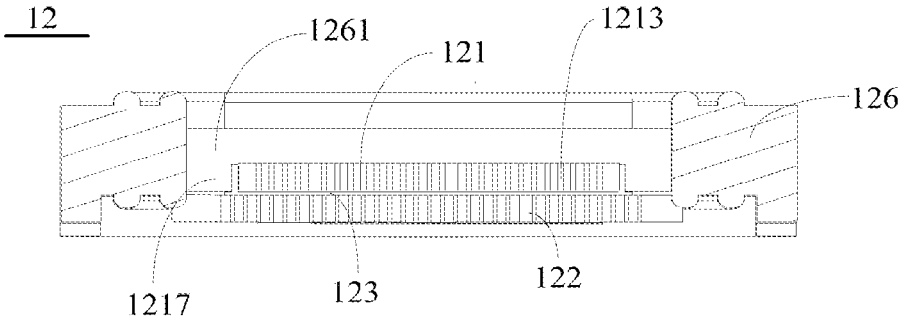
FIG. 9*c* is a schematic cross-sectional view of the heating assembly provided in FIG. 9*a* in a direction C-C.
Figure 9D:
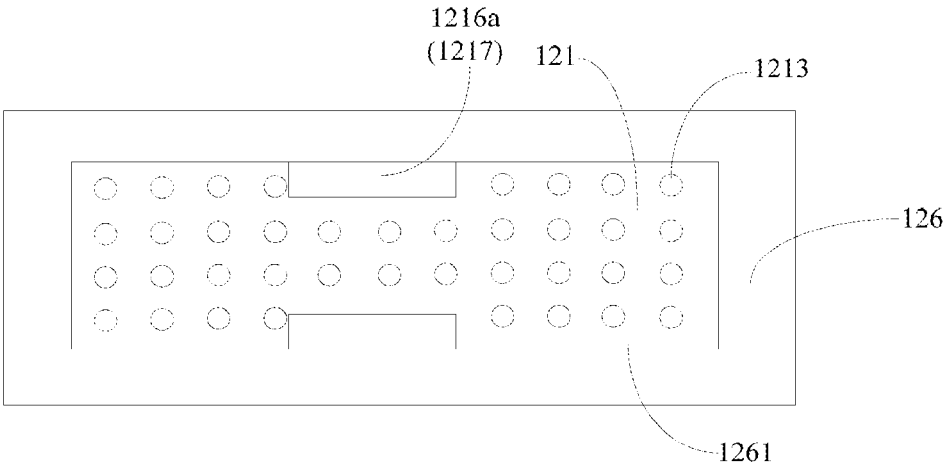
FIG. 9*d* is a schematic structural diagram of another implementation of a liquid inlet in a fourth embodiment of a heating assembly according to this application.
Figure 9E:
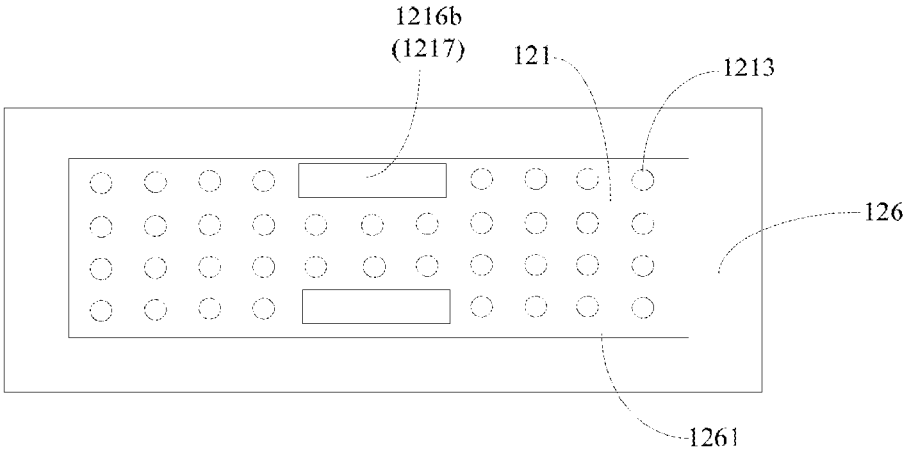
FIG. 9*e* is a schematic structural diagram of still another implementation of a liquid inlet in a fourth embodiment of a heating assembly according to this application.

Referring to FIG. 9*a*, FIG. 9*b*, FIG. 9*c*, FIG. 9*d*, and FIG. 9*e*, FIG. 9*a* is a schematic top structural view of a fourth embodiment of a heating assembly according to this application, FIG. 9*b* is a schematic cross-sectional view of the heating assembly provided in FIG. 9*a* in a direction B-B, FIG. 9*c* is a schematic cross-sectional view of the heating assembly provided in FIG. 9*a* in a direction C-C, FIG. 9*d* is a schematic structural diagram of another implementation of a liquid inlet in a fourth embodiment of a heating assembly according to this application, and FIG. 9*e* is a schematic structural diagram of still another implementation of a liquid inlet in a fourth embodiment of a heating assembly according to this application.

A difference between the fourth embodiment of the heating assembly 12 and the first embodiment of the heating assembly 12 lies in that: in the fourth embodiment of the heating assembly 12, a liquid inlet 1217 is provided on one side of an edge of the first substrate 121, and arrangement manners of other structures are all the same as those in the first embodiment of the heating assembly 12, which are not described herein again.

In the fourth embodiment of the heating assembly 12, at least a part of the edge of the first substrate 121 and the hole wall of the liquid supplying hole 1261 of the seal member 126 are spaced to form the liquid inlet 1217; or the edge of the first substrate 121 is provided with a notch 1216*a* or a through hole 1216*b* to form the liquid inlet 1217. The second substrate 122 crosses the entire liquid supplying hole 1261.

Optionally, two opposite long sides of the first substrate 121 are respectively spaced from the hole wall of the liquid supplying hole 1261 to form two symmetrically provided liquid inlets 1217 (as shown in FIG. 9*a*).

Optionally, the edge of the first substrate 121 is provided with a notch 1216*a*, and the notch 1216*a* cooperates with the hole wall of the liquid supplying hole 1261 to form the liquid inlet 1217; and an opening size and a number of the notches 1216*a* are designed as required (as shown in FIG. 9*d*).

Optionally, the edge of the first substrate 121 is provided with a through hole 1216*b* to form the liquid inlet 1217; and a size, a shape, and a number of the through holes 1216*b* are designed as required (as shown in FIG. 9*e*).

A projection of the first substrate 121 on the vaporization surface totally covers the heating component 124, and the liquid inlet 1217 and the heating component 124 are staggered. A section size of the liquid inlet 1217 is greater than the pore size of each of the plurality of first micropores 1213, that is, a liquid supplying speed at the liquid inlet 1217 of the aerosol-generation substrate is greater than a liquid supplying speed at each of the plurality of first micropores 1213. By providing the liquid inlet 1217 on the first substrate 121, not only liquid supplement may be performed to the gap 123 through the liquid inlet 1217, but also bubbles may be removed through the liquid inlet 1217, thereby avoiding the impact of the bubbles entering the liquid storage cavity 13 on liquid supplying and further preventing dry burning.

It may be understood that, in the fourth embodiment of the heating assembly 12, a fixing structure 1261*a* may be also arranged on the hole wall of the liquid supplying hole 1261 of the seal member 126, to fix the first substrate 121 and/or the second substrate 122, and the first substrate 121 and the second substrate 122 are spaced to form the gap 123. For details, reference may be made to the second embodiment of the heating assembly 12, and details are not described herein again. The liquid inlet 1217 provided in the fourth embodiment of the heating assembly 12 may be also applied to other embodiments of the heating assembly 12, which is specifically designed as required.

Figure 10A:
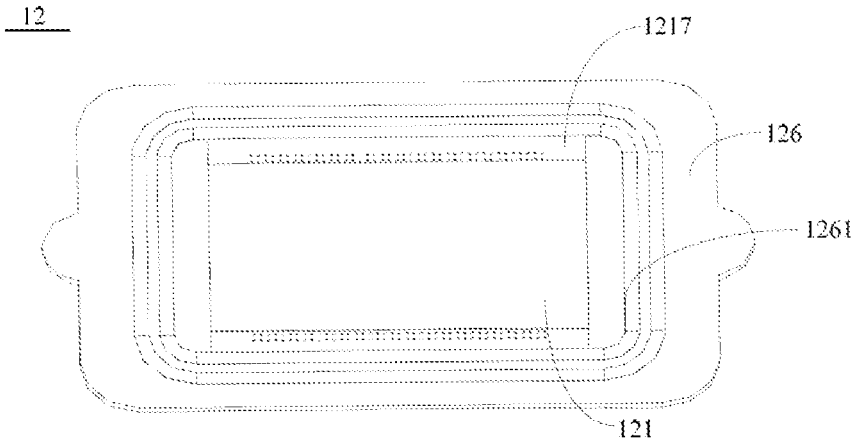
FIG. 10*a* is a schematic top structural view of a fifth embodiment of a heating assembly according to this application.
Figure 10B:
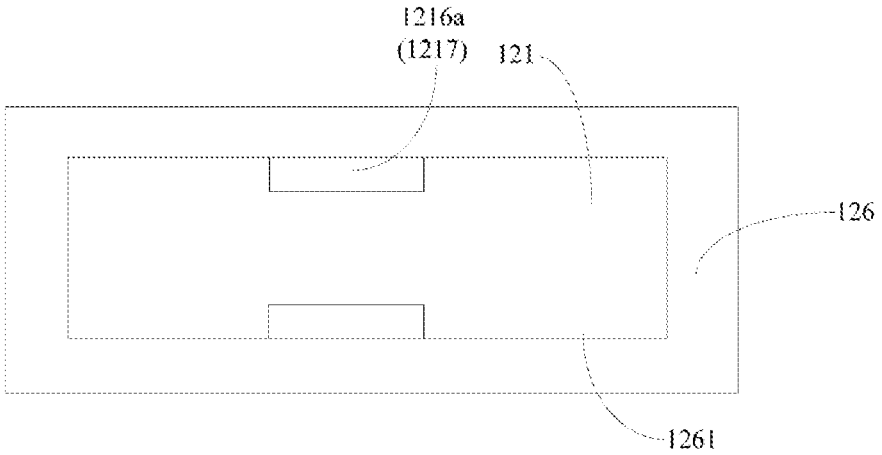
FIG. 10*b* is a schematic structural diagram of another implementation of a liquid inlet in a fifth embodiment of a heating assembly according to this application.
Figure 10C:
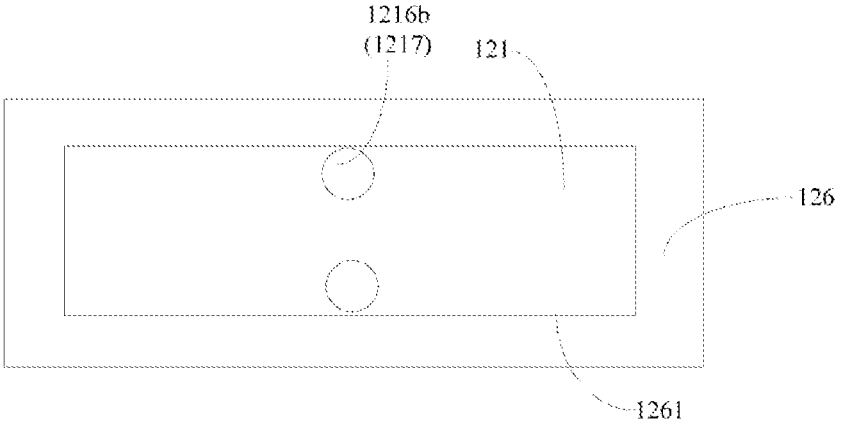
FIG. 10*c* is a schematic structural diagram of still another implementation of a liquid inlet in a fifth embodiment of a heating assembly according to this application.

Referring to FIG. 10*a*, FIG. 10*b*, and FIG. 10*c*, FIG. 10*a* is a schematic top structural view of a fifth embodiment of a heating assembly according to this application, FIG. 10*b* is a schematic structural diagram of another implementation of a liquid inlet in a fifth embodiment of a heating assembly according to this application, and FIG. 10*c* is a schematic structural diagram of still another implementation of a liquid inlet in a fifth embodiment of a heating assembly according to this application.

A difference between the fifth embodiment of the heating assembly 12 and the first embodiment of the heating assembly 12 lies in that: in the fifth embodiment of the heating assembly 12, a liquid inlet 1217 is provided on one side of an edge of the first substrate 121, no first micropore 1213 is provided on the first substrate 121, and arrangement manners of other structures are all the same as those in the first embodiment of the heating assembly 12, which are not described herein again.

In the fifth embodiment of the heating assembly 12, no first micropore 1213 is provided on the first substrate 121. At least a part of the edge of the first substrate 121 and the hole wall of the liquid supplying hole 1261 of the seal member 126 are spaced to form the liquid inlet 1217; or the edge of the first substrate 121 is provided with a notch 1216*a* or a through hole 1216*b* to form the liquid inlet 1217. The second substrate 122 crosses the entire liquid supplying hole 1261.

Optionally, two opposite long sides of the first substrate 121 are respectively spaced from the hole wall of the liquid supplying hole 1261 to form two symmetrically provided liquid inlets 1217 (as shown in FIG. 10*a*).

Optionally, the edge of the first substrate 121 is provided with a notch 1216*a*, and the notch 1216*a* cooperates with the hole wall of the liquid supplying hole 1261 to form the liquid inlet 1217; and an opening size and a number of the notches 1216*a* are designed as required (as shown in FIG. 10*b*).

Optionally, the edge of the first substrate 121 is provided with a through hole 1216*b* to form the liquid inlet 1217; and a size, a shape, and a number of the through holes 1216*b* are designed as required (as shown in FIG. 10*c*).

A projection of the first substrate 121 on the vaporization surface totally covers the heating component 124, and the liquid inlet 1217 and the heating component 124 are staggered. By providing the liquid inlet 1217 on the first substrate 121, not only liquid supplement may be performed to the gap 123 through the liquid inlet 1217, but also bubbles may be removed through the liquid inlet 1217, thereby avoiding the impact of the bubbles entering the liquid storage cavity 13 on liquid supplying and further preventing dry burning.

Figure 10D:
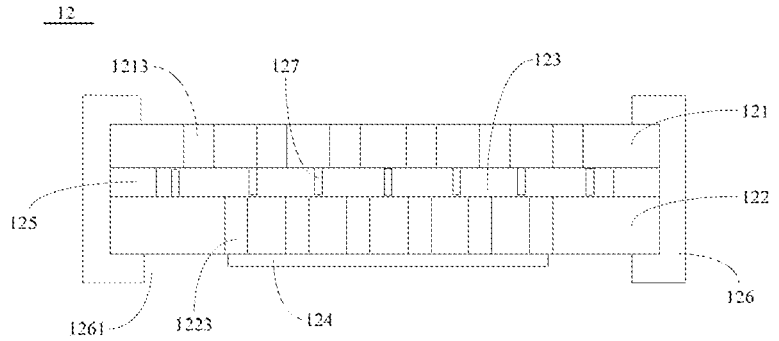
FIG. 10*d* is a schematic structural diagram of a sixth embodiment of a heating assembly according to this application.

Referring to FIG. 10*d*, FIG. 10*d* is a schematic structural diagram of a sixth embodiment of a heating assembly according to this application.

A difference between the sixth embodiment of the heating assembly 12 and the first embodiment of the heating assembly 12 lies in that: the heating assembly 12 further includes a plurality of microcolumns 127, and the plurality of microcolumns 127 are arranged in the gap 123. In the sixth embodiment of the heating assembly 12, in addition to difference of the arrangement of the plurality of microcolumns 127 in the gap 123 from the first embodiment of the heating assembly 12, arrangement manners of other structures are all the same as those in the first embodiment of the heating assembly 12, and details are not described herein again.

Specifically, one end of each of the plurality of microcolumns 127 abuts against the second surface 1212 of the first substrate 121, and an other end of each of the plurality of microcolumns 127 and the third surface 1221 of the second substrate 122 are spaced (a first manner); or one end of each of the plurality of microcolumns 127 abuts against the third surface 1221 of the second substrate 122, and an other end of each of the plurality of microcolumns 127 and the second surface 1212 of the first substrate 121 are spaced (a second manner); or one end of each of the plurality of microcolumns 127 abuts against the second surface 1212 of the first substrate 121, and an other end of each of the plurality of microcolumns 127 abuts against the third surface 1221 of the second substrate 122 (a third manner).

The plurality of microcolumns 127 may all adopt the first manner; the plurality of microcolumns 127 may all adopt the second manner; the plurality of microcolumns 127 may all adopt the third manner; and the plurality of microcolumns 127 may partially adopt the first manner, partially adopt the second manner, and partially adopt the third manner.

The microcolumn 127 may be a waste material generated when processing is performed on the first substrate 121 and the second substrate 122. For example, when the material of the first substrate 121 and the material of the second substrate 122 is glass or silicon, the microcolumn 127 may be a micro protrusion generated when drilling is performed on the first substrate 121 and the second substrate 122. When the material of the first substrate 121 and the material of the second substrate 122 is dense ceramic, the microcolumn 127 may be residual slag after drilling is performed on the first substrate 121 and the second substrate 122.

By arranging the plurality of microcolumns 127 in the gap 123, after entering the plurality of first micropores 1213, the aerosol-generation substrate may enter the gap 123 along the plurality of microcolumns 127, so that the gap 123 is well filled with the aerosol-generation substrate. Each of the plurality of microcolumns 127 may generate a function similar to a liquid bridge, to implement transverse liquid supplement, and adhesion between the aerosol-generation substrate and each of the plurality of microcolumns 127 may increase flow resistance, thereby effectively preventing reflux.

It may be understood that, the structure or arranging the plurality of microcolumns 127 in the gap 123 in the sixth embodiment of the heating assembly 12 may be also applied to other embodiments of the heating assembly 12, which is specifically designed as required.

Figure 11:
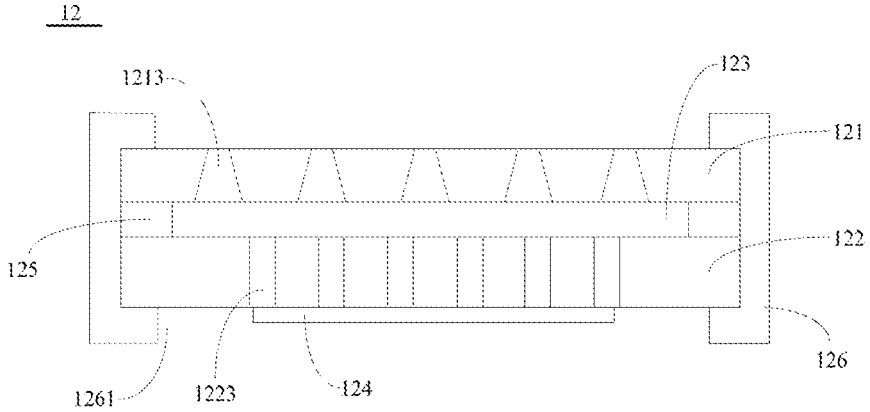
FIG. 11 is a schematic structural diagram of a seventh embodiment of a heating assembly according to this application.

Referring to FIG. 11, FIG. 11 is a schematic structural diagram of a seventh embodiment of a heating assembly according to this application.

A difference between the seventh embodiment of the heating assembly 12 and the first embodiment of the heating assembly 12 lies in that: in the seventh embodiment of the heating assembly 12, in a thickness direction of the first substrate 121, the pore size of each of the plurality of first micropores 1213 is gradually increased, a shrinking opening of each of the plurality of first micropores 1213 is provided on the first surface 1211, and an expanding opening of each of the plurality of first micropores 1213 is provided on the second surface 1212. In the seventh embodiment of the heating assembly 12, in addition to the difference of a shape of a longitudinal section of each of the plurality of first micropores 1213 from the first embodiment of the heating assembly 12, arrangement manners of other structures are all the same as those in the first embodiment of the heating assembly 12, and details are not described herein again.

By providing the shrinking opening of each of the plurality of first micropores 1213 on the first surface 1211, the shrinking opening is in communication with the liquid storage cavity 13, and the expanding opening is in communication with the gap 123, thereby ensuring stable liquid supplying of each of the plurality of first micropores 1213 on the first substrate 121, so that the gap 123 can be fully filled. In addition, through the arrangement of the plurality of first micropores 1213, the aerosol-generation substrate may be prevented from refluxing from the gap 123 to the liquid storage cavity 13, and it is ensured that air may not enter the liquid storage cavity 13 after inhalation is ended.

In an implementation, in the thickness direction of the first substrate 121, the longitudinal section of each of the plurality of first micropores 1213 is in a shape of a trapezoid. The following compares cases that the longitudinal section of each of the plurality of first micropores 1213 is in a shape of a rectangle and in a shape of a trapezoid.

It may be understood that, the arrangement manner of the plurality of first micropores 1213 in the seventh embodiment of the heating assembly 12 may be also applied to other embodiments of the heating assembly 12, which is specifically designed as required.

Figure 12:
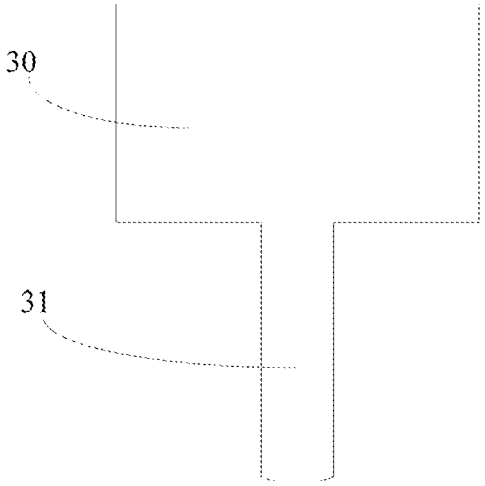
FIG. 12 is a schematic structural diagram of a first experimental member.
Figure 13:
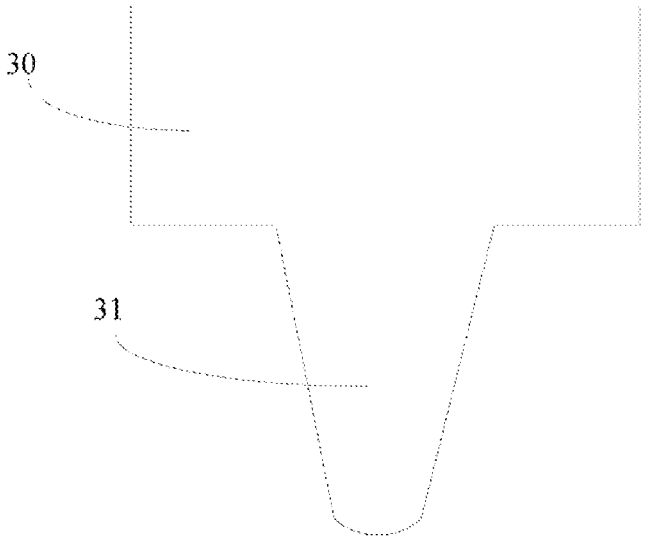
FIG. 13 is a schematic structural diagram of a second experimental member.
Figure 14:
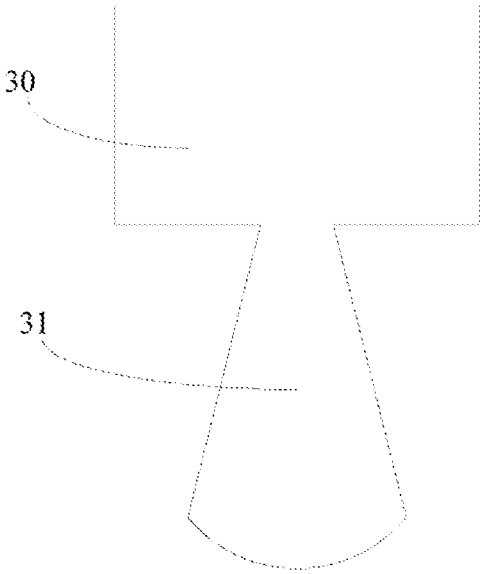
FIG. 14 is a schematic structural diagram of a third experimental member.

Referring to FIG. 12 to FIG. 14, FIG. 12 is a schematic structural diagram of a first experimental member, FIG. 13 is a schematic structural diagram of a second experimental member, and FIG. 14 is a schematic structural diagram of a third experimental member.

The first experimental member includes a liquid collecting cavity 30 and a pipeline 31, where a longitudinal section of the pipeline 31 is in a shape of a rectangle.

The second experimental member includes a liquid collecting cavity 30 and a pipeline 31, where a longitudinal section of the pipeline 31 is in a shape of a trapezoid, and an expanding opening of the trapezoid is in communication with the liquid collecting cavity 30.

The third experimental member includes a liquid collecting cavity 30 and a pipeline 31, where a longitudinal section of the pipeline 31 is in a shape of a trapezoid, and a shrinking opening of the trapezoid is in communication with the liquid collecting cavity 30.

By performing experiments on the first experimental member, the second experimental member, and the third experimental member, it is found that under the action of surface tension, liquid is blocked in the pipeline 31, and a liquid surface protrudes downward at an opening of the pipeline 31 (as shown in FIG. 12 to FIG. 14). When heights of liquid surfaces in the liquid collecting cavities 30 are the same, it is found that the liquid surface at the opening of the pipeline 31 in the third experimental member protrudes downward to the greatest extent. Therefore, the plurality of first micropores 1213 may be set to that the pore size of each of the plurality of first micropores 1213 is gradually increased in the thickness direction of the first substrate 121, the shrinking opening of each of the plurality of first micropores 1213 is provided on the first surface 1211, and the expanding opening of each of the plurality of first micropores 1213 is provided on the second surface 1212. In this way, the aerosol-generation substrate protruding from each of the plurality of first micropores 1213 can be in contact with the surface of the second substrate 122 more easily, and the aerosol-generation substrate is further in communication with the plurality of second micropores 1223 on the second substrate 122, to accelerate a liquid guiding speed.

The foregoing descriptions are merely implementations of this application, and the patent scope of this application is not limited thereto. All equivalent structure or process changes made according to the content of this specification and the accompanying drawings in this application or by directly or indirectly applying this application in other related technical fields shall fall within the protection scope of this application.

What is claimed is:

1. A heating assembly, comprising:

a first substrate, comprising a first surface and a second surface arranged opposite to each other, wherein the first surface is a liquid absorbing surface, the first substrate comprises a plurality of first micropores configured to guide an aerosol-generation substrate from the liquid absorbing surface to the second surface;

a second substrate, comprising a third surface and a fourth surface arranged opposite to each other, wherein the fourth surface is a vaporization surface, the second surface and the third surface are arranged opposite to each other; and a seal member configured to fully surround a circumferential periphery of both the first substrate and the second substrate, the respectively surrounded first substrate and second substrate being arranged within a respective mounting groove formed in the seal member, wherein the second substrate is a dense substrate, a plurality of second micropores running through the third surface and the fourth surface are provided on the second substrate, and the plurality of second micropores are configured to guide the aerosol-generation substrate from the third surface to the vaporization surface, wherein at least one of the first substrate and the second substrate forms a flow channel that communicates the plurality of first micropores and the plurality of second micropores, and wherein the heating assembly is in fluid communication with a liquid storage cavity, configured to store the aerosol-generation substrate, the liquid storage cavity surrounding an air outlet channel.

2. The heating assembly according to claim 1, wherein the second surface and the third surface are spaced to form a gap that serves as the flow channel.

3. The heating assembly according to claim 2, wherein the heating assembly further comprises a spacer arranged between the second surface and the third surface, wherein the spacer is arranged at an edge of the first substrate and/or an edge of the second substrate, and the first substrate and the second substrate are spaced to form the gap.

4. The heating assembly according to claim 3, wherein the spacer is one of:

a gasket;

a support column or a support frame fixed to at least one of the second surface and the third surface; or a protrusion integrally formed with at least one of the first substrate and the second substrate.

5. The heating assembly according to claim 2, wherein the seal member comprises a liquid supplying hole, the heating assembly further comprising:

a fixing structure arranged on a wall of the liquid supplying hole and configured to fix both the first substrate and the second substrate, wherein the first substrate and the second substrate are spaced to form the gap.

6. The heating assembly according to claim 2, wherein the gap has a height that is constant in a direction parallel to the first substrate.

7. The heating assembly according to claim 2, wherein the gap has a height that is gradually increased in a direction parallel to the first substrate.

8. The heating assembly according to claim 7, wherein the height of the gap is gradually increased from zero.

9. The heating assembly according to claim 2, further comprising a plurality of microcolumns arranged in the gap.

10. The heating assembly according to claim 9, wherein:

one end of each of the plurality of microcolumns abuts against the second surface, and the other end of each of the plurality of microcolumns and the third surface are spaced; or one end of each of the plurality of microcolumns abuts against the third surface, and the other end of each of the plurality of microcolumns and the second surface are spaced; or one end of each of the plurality of microcolumns abuts against the second surface, and the other end of each of the plurality of microcolumns abuts against the third surface.

11. The heating assembly according to claim 1, wherein:

a plurality of first grooves extending in a first direction and a plurality of second grooves extending in a second direction are provided on the third surface, the plurality of first grooves and the plurality of second grooves are provided in an intersecting manner, and the plurality of first grooves and the plurality of second grooves form the flow channel.

12. The heating assembly according to claim 11, wherein:

the plurality of second micropores are distributed in an array, each of the plurality of first grooves corresponds to one or more rows of second micropores, and each of the plurality of second grooves corresponds to one or more columns of second micropores.

13. The heating assembly according to claim 11, wherein a ratio of a depth to a width of each of the plurality of first grooves ranges from 0 to 20, and a ratio of a depth to a width of each of the plurality of second grooves ranges from 0 to 20.

14. The heating assembly according to claim 11, wherein:

a plurality of third grooves extending in a third direction and a plurality of fourth grooves extending in a fourth direction are provided on the second surface, the plurality of third grooves and the plurality of fourth grooves are provided in an intersecting manner, and the plurality of first grooves, the plurality of second grooves, the plurality of third grooves, and the plurality of fourth grooves together form the flow channel.

15. The heating assembly according to claim 14, wherein:

the first substrate is a dense substrate, the plurality of first micropores run through the first surface and the second surface, the plurality of first micropores are distributed in an array, each of the plurality of third grooves corresponds to one or more rows of first micropores, and each of the plurality of fourth grooves corresponds to one or more columns of first micropores.

16. The heating assembly according to claim 14, wherein a ratio of a depth to a width of each of the plurality of third grooves ranges from 0 to 20, and a ratio of a depth to a width of each of the plurality of fourth grooves ranges from 0 to 20.

17. The heating assembly according to claim 14, wherein a capillary force of the plurality of first grooves and the plurality of second grooves is greater than a capillary force of the plurality of third grooves and the plurality of fourth grooves.

18. The heating assembly according to claim 11, wherein the second surface and the third surface are spaced to form a gap.

19. The heating assembly according to claim 11, wherein the second surface is in contact with the third surface.

20. The heating assembly according to claim 19, wherein the depth of each of the plurality of first grooves and the depth of each of the plurality of second grooves are greater than the depth of each of the plurality of third grooves and the depth of each of the plurality of fourth grooves.

21. The heating assembly according to claim 1, wherein a central axis of each of the plurality of second micropores is perpendicular to the third surface.

22. The heating assembly according to claim 1, wherein a thickness of the second substrate ranges from 0.1 mm to 1 mm, and a pore size of each of the plurality of second micropores ranges from 1 μm to 100 μm.

23. The heating assembly according to claim 1, wherein a ratio of a thickness of the second substrate to a pore size of each of the plurality of second micropores ranges from 20:1 to 3:1.

24. The heating assembly according to claim 1, wherein a ratio of a distance between centers of adjacent second micropores to a pore size of each of the plurality of second micropores ranges from 3:1 to 5:1.

25. The heating assembly according to claim 1, wherein the first substrate is a dense substrate, and the plurality of first micropores run through the first surface and the second surface.

26. The heating assembly according to claim 25, wherein a capillary force of the plurality of second micropores is greater than a capillary force of the plurality of first micropores.

27. The heating assembly according to claim 25, wherein:

a pore size of each of the plurality of first micropores is gradually increased in a thickness direction of the first substrate, and each micropore has a first opening on the first surface and a second opening on the second surface, the first opening being smaller than the second opening.

28. The heating assembly according to claim 25, wherein a projection of a region of the first substrate on which the plurality of first micropores are provided covers a region of the second substrate on which the plurality of second micropores are provided.

29. The heating assembly according to claim 25, wherein a pore size of each of the plurality of first micropores ranges from 1 μm to 100 μm.

30. The heating assembly according to claim 1, wherein a thickness of the first substrate is less than a thickness of the second substrate.

31. The heating assembly according to claim 1, further comprising a heating component arranged on the vaporization surface.

32. The heating assembly according to claim 1, wherein the second substrate has a conductive function.

33. The heating assembly according to claim 31, wherein a projection of the first substrate on the vaporization surface covers the heating component.

34. A heating assembly, comprising:

a first substrate, comprising a first surface and a second surface arranged opposite to each other, wherein the first surface is a liquid absorbing surface, and the first substrate comprises a plurality of first micropores configured to guide an aerosol-generation substrate from the liquid absorbing surface to the second surface;

a second substrate, comprising a third surface and a fourth surface arranged opposite to each other, wherein the fourth surface is a vaporization surface, the second surface and the third surface are arranged opposite to each other, and the second substrate comprises a plurality of second micropores are configured to guide the aerosol-generation substrate from the third surface to the vaporization surface; and a seal member configured to fully surround a circumferential periphery of both the first substrate and the second substrate, the respectively surrounded first substrate and second substrate being arranged within a respective mounting groove formed in the seal member, wherein at least one of the first substrate and the second substrate forms a flow channel that communicates the plurality of first micropores and the plurality of second micropores, and wherein the heating assembly is in fluid communication with a liquid storage cavity, configured to store the aerosol-generation substrate, the liquid storage cavity surrounding an air outlet channel.

35. A vaporizer, comprising:

a liquid storage cavity, configured to store an aerosol-generation substrate, the liquid storage cavity surrounding an air outlet channel; and a heating assembly, in fluid communication with the liquid storage cavity and configured to vaporize the aerosol-generation substrate, the heating assembly comprising:

a first substrate, comprising a first surface and a second surface arranged opposite to each other, wherein the first surface is a liquid absorbing surface, the first substrate comprises a plurality of first micropores configured to guide an aerosol-generation substrate from the liquid absorbing surface to the second surface;

a second substrate, comprising a third surface and a fourth surface arranged opposite to each other, wherein the fourth surface is a vaporization surface, the second surface and the third surface are arranged opposite to each other; and a seal member configured to fully surround a circumferential periphery of both the first substrate and the second substrate, the respectively surrounded first substrate and second substrate being arranged within a respective mounting groove formed in the seal member, wherein the second substrate is a dense substrate, a plurality of second micropores running through the third surface and the fourth surface are provided on the second substrate, and the plurality of second micropores are configured to guide the aerosol-generation substrate from the third surface to the vaporization surface, and wherein at least one of the first substrate and the second substrate forms a flow channel that communicates the plurality of first micropores and the plurality of second micropores.

36. An electronic vaporization device, comprising:

a vaporizer, comprising:

a liquid storage cavity, configured to store an aerosol-generation substrate, the liquid storage cavity surrounding an air outlet channel; and a heating assembly, in fluid communication with the liquid storage cavity and configured to vaporize the aerosol-generation substrate, the heating assembly comprising:

a first substrate, comprising a first surface and a second surface arranged opposite to each other, wherein the first surface is a liquid absorbing surface, the first substrate comprises a plurality of first micropores configured to guide an aerosol-generation substrate from the liquid absorbing surface to the second surface;

a second substrate, comprising a third surface and a fourth surface arranged opposite to each other, wherein the fourth surface is a vaporization surface, the second surface and the third surface are arranged opposite to each other; and a seal member configured to fully surround a circumferential periphery of both the first substrate and the second substrate, the respectively surrounded first substrate and second substrate being arranged within a respective mounting groove formed in the seal member, wherein the second substrate is a dense substrate, a plurality of second micropores running through the third surface and the fourth surface are provided on the second substrate, and the plurality of second micropores are configured to guide the aerosol-generation substrate from the third surface to the vaporization surface, and wherein at least one of the first substrate and the second substrate forms a flow channel that communicates the plurality of first micropores and the plurality of second micropores; and a main unit, configured to supply electric energy for operation of the vaporizer and control the heating assembly to vaporize the aerosol-generation substrate.

* * * * *